US011239567B2

(12) United States Patent
Freebury et al.

(10) Patent No.: US 11,239,567 B2
(45) Date of Patent: Feb. 1, 2022

(54) ANTENNA

(71) Applicant: TENDEG LLC, Louisville, CO (US)

(72) Inventors: Gregg E. Freebury, Louisville, CO (US); Matthew Phillip Mitchell, Colorado Springs, CO (US)

(73) Assignee: TENDEG LLC, Louisville, CO (US)

( * ) Notice: Subject to any disclaimer, the term of this patent is extended or adjusted under 35 U.S.C. 154(b) by 0 days.

(21) Appl. No.: 16/869,420

(22) Filed: May 7, 2020

(65) Prior Publication Data

US 2020/0358200 A1 Nov. 12, 2020

Related U.S. Application Data

(60) Provisional application No. 62/845,171, filed on May 8, 2019.

(51) Int. Cl.
*H01Q 15/14* (2006.01)
*H01Q 15/16* (2006.01)

(52) U.S. Cl.
CPC ..... *H01Q 15/14* (2013.01); *H01Q 15/141* (2013.01); *H01Q 15/147* (2013.01); *H01Q 15/161* (2013.01); *H01Q 15/162* (2013.01)

(58) Field of Classification Search
CPC .... H01Q 15/14; H01Q 15/147; H01Q 15/141; H01Q 15/148; H01Q 15/16; H01Q 15/161; H01Q 15/162; H01Q 15/165; H01Q 15/168; H01Q 15/20; H01Q 19/19; H01Q 19/175
See application file for complete search history.

(56) References Cited

U.S. PATENT DOCUMENTS

| | | | |
|---|---|---|---|
| 2,325,616 | A | 8/1943 | Landweber |
| 3,144,104 | A | 8/1964 | Weir et al. |
| 3,144,215 | A | 8/1964 | Klein |
| 3,208,478 | A | 9/1965 | Baines |
| 3,213,573 | A | 10/1965 | Bohr et al. |
| 3,281,849 | A | 10/1966 | Andreasen et al. |
| 3,300,910 | A | 1/1967 | Isaac |
| 3,360,894 | A | 1/1968 | Orr et al. |
| 3,361,377 | A | 1/1968 | Trexler |
| 3,385,397 | A | 5/1968 | Robinsky |
| 3,434,674 | A | 3/1969 | Groskopfs |
| 3,503,164 | A | 3/1970 | Berry et al. |

(Continued)

FOREIGN PATENT DOCUMENTS

| | | |
|---|---|---|
| JP | H11 293776 | 10/1999 |
| JP | H11 293777 | 10/1999 |

(Continued)

OTHER PUBLICATIONS

Moog Inc. Type 22 Antenna Pointing Assembly. Website, https://www.moog.com/content/dam/moog/literature/Space_Defense/spaceliterature/spacecraft_mechanisms/500-615_Type_22_APM.pdf, originally downloaded Dec. 6, 2019, 2 pages.

(Continued)

*Primary Examiner* — Vibol Tan
(74) *Attorney, Agent, or Firm* — Craig R. Miles; CR Miles P.C.

(57) ABSTRACT

An antenna having a reflector mounted on a rigid boom uses a line feed or phased array feed to operate in the Ka band with frequencies up to 36 gigahertz while maintaining the ability to operate at frequencies down to L-Band of 1-2 GHz.

14 Claims, 16 Drawing Sheets

(56) References Cited

U.S. PATENT DOCUMENTS

| | | | | |
|---|---|---|---|---|
| 3,528,543 | A | 9/1970 | Robinsky | |
| 3,564,789 | A | 2/1971 | Vyvyan et al. | |
| 3,589,632 | A | 6/1971 | Rew | |
| 3,608,844 | A | 9/1971 | Tumulty et al. | |
| 3,696,568 | A | 10/1972 | Berry | |
| 3,784,441 | A | 1/1974 | Kaempen | |
| 3,811,633 | A | 5/1974 | Cummings et al. | |
| 3,862,528 | A | 1/1975 | Meissinger | |
| 3,957,416 | A | 5/1976 | Kaempen | |
| 4,047,339 | A | 9/1977 | Smith et al. | |
| 4,519,434 | A | 5/1985 | Forquer | |
| 4,543,998 | A | 10/1985 | Thomerson | |
| 4,544,928 | A | 10/1985 | Afifi et al. | |
| 4,613,870 | A | 9/1986 | Stonier | |
| 4,723,349 | A | 2/1988 | Grimes | |
| 4,725,025 | A * | 2/1988 | Binge | B64G 9/00 136/245 |
| 4,796,797 | A | 1/1989 | Nakako et al. | |
| 4,885,891 | A | 12/1989 | Lynch | |
| 4,991,784 | A | 2/1991 | Schmid | |
| 5,088,014 | A | 2/1992 | Boughey | |
| 5,235,788 | A | 8/1993 | Maimets | |
| 5,348,096 | A | 9/1994 | Williams | |
| 5,446,474 | A | 8/1995 | Wade et al. | |
| 5,474,123 | A | 12/1995 | Buckshaw | |
| 5,680,145 | A | 10/1997 | Thomson et al. | |
| 5,882,322 | A | 3/1999 | Kim et al. | |
| 5,913,151 | A * | 6/1999 | Lusignan | H01Q 13/02 455/3.01 |
| 5,990,851 | A | 11/1999 | Henderson et al. | |
| 6,028,570 | A | 2/2000 | Gilger et al. | |
| 6,065,540 | A | 5/2000 | Thomeer et al. | |
| 6,131,431 | A | 10/2000 | Ona | |
| 6,217,975 | B1 | 4/2001 | Daton-Lovett | |
| 6,225,965 | B1 | 5/2001 | Gilger et al. | |
| 6,256,938 | B1 | 7/2001 | Daton-Lovett | |
| 6,353,421 | B1 * | 3/2002 | Lalezari | H01Q 1/288 343/881 |
| 6,388,637 | B1 | 5/2002 | Davis | |
| 6,454,493 | B1 | 9/2002 | Lohbeck | |
| 6,542,132 | B2 | 4/2003 | Stern | |
| 6,602,574 | B1 | 8/2003 | Daton-Lovett | |
| 6,920,722 | B2 | 6/2005 | Brown et al. | |
| 7,024,158 | B2 | 4/2006 | Wiswell | |
| 7,251,323 | B2 | 7/2007 | Holtorf et al. | |
| 7,617,639 | B1 | 11/2009 | Pollard et al. | |
| 7,694,465 | B2 | 4/2010 | Pryor | |
| 7,806,370 | B2 | 10/2010 | Beidleman et al. | |
| 7,895,795 | B1 | 3/2011 | Murphey et al. | |
| 8,006,462 | B2 | 8/2011 | Murphy et al. | |
| 8,061,660 | B2 | 11/2011 | Beidleman et al. | |
| 8,167,247 | B2 | 5/2012 | Daily et al. | |
| 8,356,774 | B1 | 1/2013 | Banik et al. | |
| 8,480,241 | B1 | 7/2013 | Tenerelli et al. | |
| 8,689,514 | B1 | 4/2014 | Sternowski | |
| 8,893,442 | B1 | 11/2014 | Spence et al. | |
| 9,528,264 | B2 | 12/2016 | Freebury et al. | |
| 9,590,299 | B2 | 3/2017 | Rao et al. | |
| 9,813,151 | B2 | 11/2017 | Kingsbury et al. | |
| 9,840,060 | B2 | 12/2017 | Francis et al. | |
| 10,170,843 | B2 | 1/2019 | Thompson et al. | |
| 10,256,530 | B2 | 4/2019 | Freebury et al. | |
| 10,263,316 | B2 * | 4/2019 | Harvey | H01Q 1/28 |
| 10,516,216 | B2 * | 12/2019 | Harless | H01Q 15/161 |
| 10,587,035 | B2 * | 3/2020 | Freebury | H01Q 1/288 |
| 2001/0050657 | A1 | 12/2001 | Meguro et al. | |
| 2002/0112417 | A1 | 8/2002 | Brown et al. | |
| 2002/0170612 | A1 | 11/2002 | Penza | |
| 2002/0179772 | A1 | 12/2002 | Ohmer et al. | |
| 2005/0011569 | A1 | 1/2005 | Della Putta et al. | |
| 2005/0104798 | A1 | 5/2005 | Nolan et al. | |
| 2006/0181788 | A1 | 8/2006 | Harada et al. | |
| 2007/0006963 | A1 | 1/2007 | Bever | |
| 2007/0181241 | A1 | 8/2007 | Kramer et al. | |
| 2008/0078139 | A1 | 4/2008 | Overby | |
| 2010/0259458 | A1 | 10/2010 | Mattis et al. | |
| 2011/0195209 | A1 | 8/2011 | Bosman et al. | |
| 2011/0204186 | A1 | 8/2011 | Keller et al. | |
| 2011/0308174 | A1 | 12/2011 | Meyer | |
| 2012/0019430 | A1 | 1/2012 | Desagulier | |
| 2012/0297717 | A1 | 11/2012 | Keller et al. | |
| 2013/0061541 | A1 | 3/2013 | Taylor et al. | |
| 2013/0229709 | A1 | 9/2013 | Newswander et al. | |
| 2015/0094104 | A1 | 4/2015 | Wilmhoff et al. | |
| 2015/0146288 | A1 | 5/2015 | Newswander et al. | |
| 2015/0194733 | A1 | 7/2015 | Mobrem et al. | |
| 2015/0288072 | A1 | 10/2015 | Medzmariashvili et al. | |
| 2015/0303582 | A1 | 10/2015 | Meschini et al. | |
| 2017/0222308 | A1 * | 8/2017 | Freebury | H01Q 15/161 |
| 2017/0254929 | A1 | 9/2017 | Dailey et al. | |
| 2019/0221944 | A1 * | 7/2019 | Harless | H01Q 1/1235 |

FOREIGN PATENT DOCUMENTS

| | | |
|---|---|---|
| WO | WO 00/64663 | 11/2000 |
| WO | WO 02/06619 | 1/2002 |
| WO | WO 2014/081943 | 5/2014 |
| WO | WO 2014/127292 | 8/2014 |

OTHER PUBLICATIONS

National Aeronautics and Space Administration. CubeSat 101. Website, https://www.nasa.gov/sites/default/files/atoms/files/nasa_csli_cubesat_101_508.pdf, dated Oct. 2017, 96 pages.

PCT International Patent Application No. PCT/US20/32023; International Search Report and Written Opinion of the International Searching Authority dated Aug. 6, 2020, 10 pages.

U.S. Appl. No. 61/729,129, filed Nov. 21, 2012, Francis et al.

U.S. Appl. No. 61/765,641, filed Feb. 15, 2013, Francis et al.

U.S. Appl. No. 61/952,018, filed Mar. 12, 2014, Freebury et al.

U.S. Appl. No. 14/645,844, filed Mar. 12, 2015, Freebury et al.

U.S. Appl. No. 14/646,002, filed May 19, 2015, Francis et al.

U.S. Appl. No. 14/767,897, filed Aug. 13, 2015, Freebury et al.

U.S. Appl. No. 62/288,350, filed Jan. 28, 2016, Freebury et al.

U.S. Appl. No. 15/387,437, filed Dec. 21, 2016, Freebury et al.

U.S. Appl. No. 62/447,127, filed Jan. 17, 2017, Freebury et al.

U.S. Appl. No. 15/871,843, filed Jan. 15, 2018, Freebury et al.

U.S. Appl. No. 16/377,013, filed Apr. 5, 2019, Freebury et al.

U.S. Appl. No. 62/845,171, filed May 8, 2019.

Patent Cooperation Treaty International Patent Application No. PCT/US20/32023, filed May 8, 2020.

PCT International Patent Application No. PCT/US2013/071266; International Search Report and Written Opinion dated May 12, 2014, 12 pages total.

PCT International Patent Application No. PCT/US2014/016605; International Search Report and Written Opinion dated Jun. 3, 2014, 13 pages total.

PCT International Patent Application No. PCT/US17/12759; International Search Report and Written Opinion dated May 26, 2017, 16 pages total.

European Patent Application No. 17744669.7; Extended European Search Report dated Aug. 13, 2019, 9 pages.

Astro Aerospace Corporation. STEM Design & Performance. Website, http://www.as.northropgrumman.com, originally downloaded Oct. 24, 2012, 9 total pages.

Galletly et al. Bistable composite slit tubes. I. A beam model. International Journal of Solids and Structures, 2004, 41:4517-4533.

Iqbal et al. Bi-Stable Composite Shells. American Institute for Aeronautics and Astronautics, 41st Structures, Structural Dynamics, and Materials Conference and Exhibit, Apr. 2000, Atlanta, GA, USA, 8 total pages.

Marks et al. Performance of the AstroMesh Deployable Mesh Reflector at Ka-Band Frequencies and Above. Fifteenth KA and Broadband Communications, Navigation and Earth Observation Conference, Sep. 23-25, 2009, Cagliari, Italy.

NASA Jet Propulsion Laboratory, "Flower Power Starshade Unfurls in Space," https://www.jpl.nasa.gov/video/details.php?id=1284. (Year: 2014).

(56) References Cited

OTHER PUBLICATIONS

Northrop Grumman. 150-lb Linear Actuator Stem. Website, http://www.as.northropgrumman.com, originally downloaded Oct. 24, 2012, 2 total pages.
Northrop Grumman. Astro Aerospace: Deployable Structures and Mechanisms for Space Applications. Website, http://www.as.northropgrumman.com, originally downloaded Jun. 12, 2015, 4 total pages.
Prigent. A Finite Element Model of Bi-Stable Woven Composite Tape-Springs. KTH, Thesis submitted to the Royal Institute of Technology for the Master's degree, Oct. 2011, Stockholm, Sweden.
Rolatube Extending Technology. Rolatube Technology: Product Brochure: Defense and Security. Website, http://www.rolatube.com, originally downloaded Oct. 24, 2012, 20 total pages.
Rolatube Extending Technology. Website, http://www.rolatube.com, originally downloaded Jun. 12, 2015, 2 total pages.
Rolatube Technology Ltd. A Brief Introduction to Bi-Stable Reeled Composites. Website, http://www.rolatube.com, originally downloaded Oct. 24, 2012, 9 total pages.
Straubel, Hillebrandt and Belvin. Results of Research Study: Evaluation of Deployable Space Mast Concepts. Final Presentation, NASA—LaRC, dated Sep. 28, 2011, 54 total pages.
Straubel. Large Deployable Structures. Gossamer Concepts for Versatile Applications. SpacePlan 2020; University of Surrey, Feb. 27, 2014, Guildford, UK; 12 pages total.
NASA Jet Propulsion Laboratory, "Flower Power Starshade Unfurls in Space," video. (Year: 2014).

* cited by examiner

ANTENNA

This United States Non-Provisional Patent Application claims the benefit of U.S. Provisional Patent Application No. 60/845,171, filed May 8, 2019, hereby incorporated by this invention.

I. GOVERNMENT LICENSE RIGHTS

This invention was made with government support under Contract Number 80NSSC18P2011 awarded by NASA SBIR Program Office. The government has certain rights in this invention.

II. FIELD OF THE INVENTION

An antenna having a reflector mounted on a boom constructed with arcuate slit tubes has the ability to use a line feed or phased array feed while taking advantage of a passive parabolic reflector gain characteristics to operate in the Ka band with frequencies up to 36 gigahertz ("GHz") while maintaining the ability to operate at frequencies down to L-Band of 1-2 GHz. In particular embodiments, the baseline design can employ an approximate 4:1 aspect ratio aperture having an approximate 1×4 m deployed aperture. While the final stowed volume may depend on the feed architecture, embodiments can have final stowed volume down to about 18,000 $cm^3$ or less. Particular embodiments of a parabolic cylinder reflector can carry out missions which require synthetic aperture radar ("SAR") technologies which utilize the flight path of the platform to simulate an extremely large antenna or aperture electronically, to generate high-resolution remote sensing imagery.

III. A BRIEF DESCRIPTION OF THE DRAWINGS

IV. DETAILED DESCRIPTION OF THE PREFERRED EMBODIMENTS

Figure 1A:
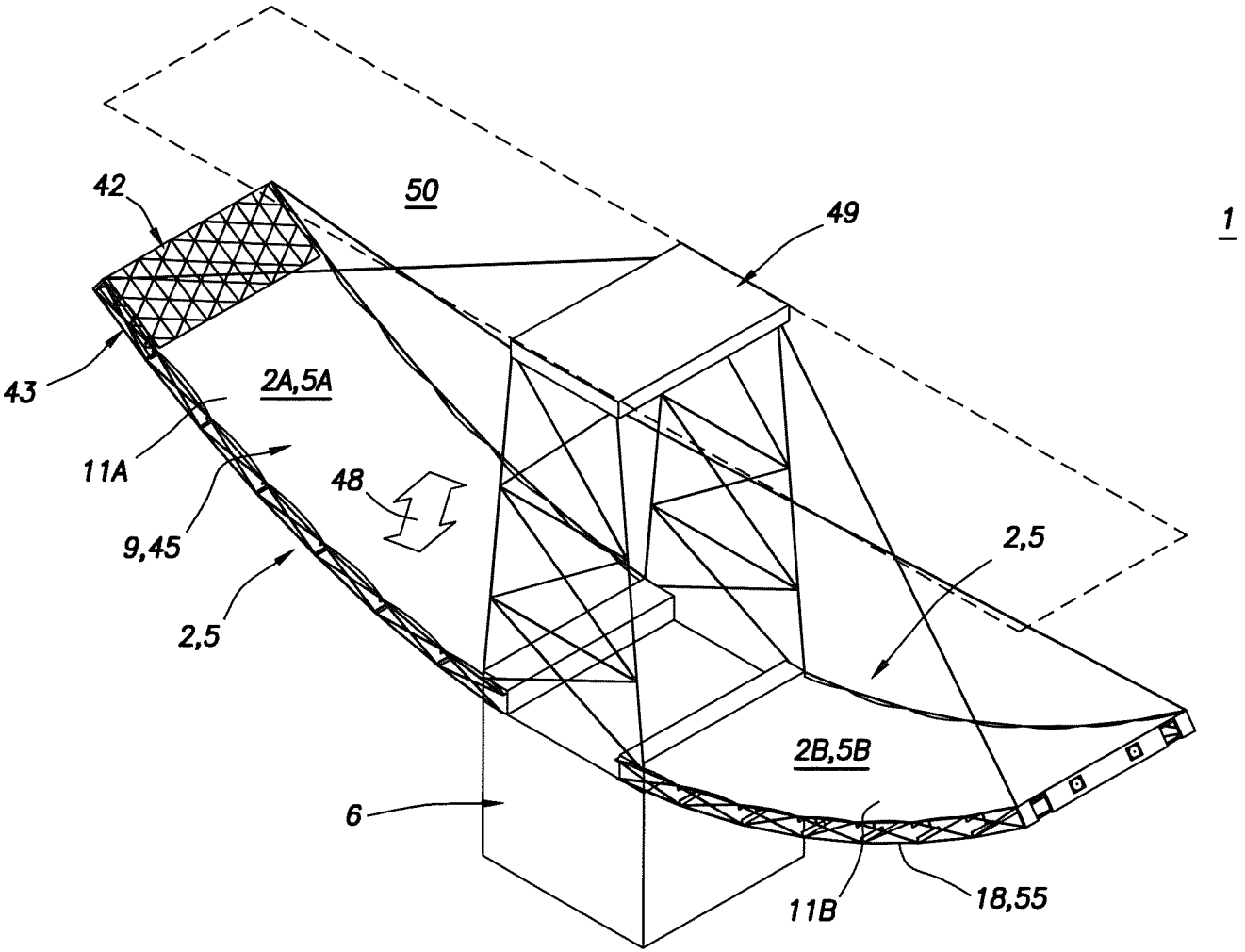
FIG. 1A is a perspective view of a particular embodiment of the inventive antenna in the deployed condition having a feed array supported in adjustable fixed spatial relation to a main reflector to transfer signals between the feed array and the main reflector.
Figure 1B:
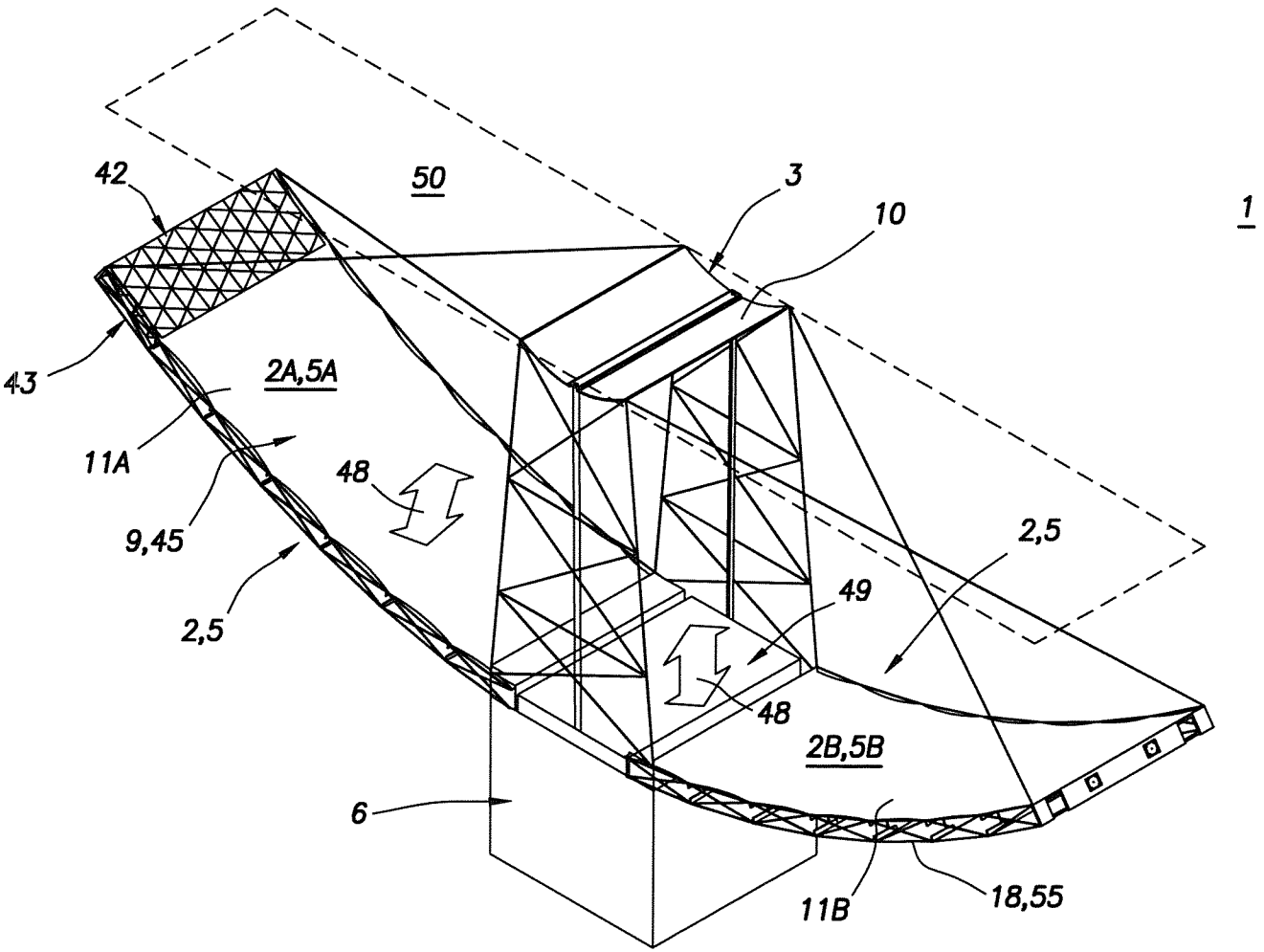
FIG. 1B is a perspective view of a particular embodiment of the inventive antenna in the deployed condition having a sub-reflector supported in adjustable fixed spatial relation to a main reflector to transfer signals between a feed array and the main reflector.
Figure 2:
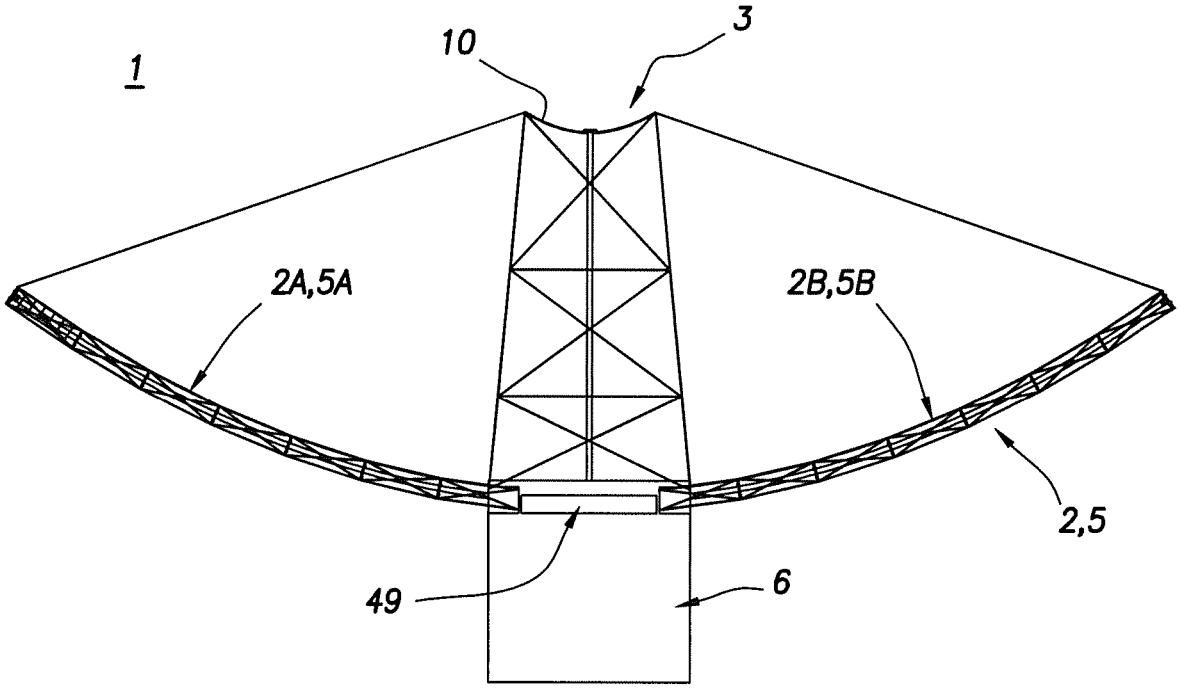
FIG. 2 is first side elevation view of the antenna in the deployed condition.
Figure 3:
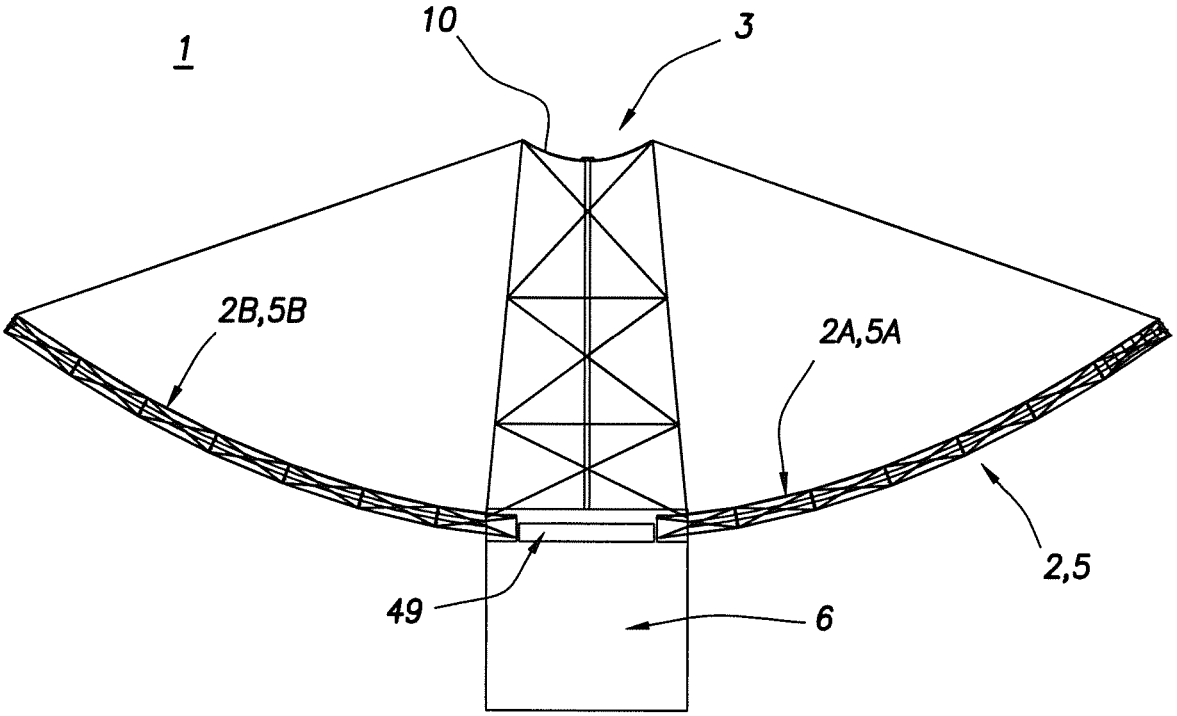
FIG. 3 is second side elevation view of the antenna in the deployed condition.

The Antenna. Generally, with reference to FIGS. 1A and 1B through 24, which illustrate embodiments of an inventive antenna (1) and methods of making an using embodiments of the antenna (1). Particular embodiments of the antenna (1) deploy a main reflector (2) and a feed (49) respectively from a stowed condition (4) within a vehicle bus (6) by corresponding operation of a main reflector deployer assembly (7) and a secondary deployer assembly (8) correspondingly toward the deployed condition (5) (as shown in the example of FIG. 1A). Optionally, embodiments of the antenna (1) deploy a main reflector (2) and a sub-reflector (3) respectively from a stowed condition (4) within a vehicle bus (6) by corresponding operation of a main reflector deployer assembly (7) and a secondary deployer assembly (8) correspondingly toward the unfurled deployed condition (5) (as shown in the example of FIG. 1B).

Embodiments of the main reflector (2) can, but need not necessarily, be configured to provide a parabolic cylinder reflector surface (9) configured as a synthetic aperture radar ("SAR") for SAR applications; however, the illustrative examples of the spatial relation of the main reflector (2) and sub-reflector (3) or feed (49) configured for SAR applications, is not intended to preclude embodiments modified to meet other missions or mission application parameters. In the illustrative embodiments shown in the Figures, the deployed configuration of the antenna (1) can, but need not necessarily, result in about a one meter by four meter ("m") effective aperture offset feed with a ratio of the focal length to the diameter ("f/D") of about 0.40; although the other configurations can be achieved and can be dimensionally scaled.

The Vehicle. Now, referring primarily to FIGS. 1 through 7, as shown in the illustrative examples, particular embodiments of the antenna (1) can be stowed within a wide variety of differently configured vehicle buses (6). In the illustrative examples, the vehicle bus (6) can comprise a CubeSat having dimensions of about 0.6 meter ("m")×0.7 m×1.0 m; however, the antenna (1) can be upwardly or downwardly scaled and in certain embodiments can be downwardly scaled to a final stowed volume of about 18,000 cubic centimeters ("$cm^3$") or less.

The Main Reflector Assembly. Now, referring primarily to FIGS. 1A and 1B through 14, the main reflector (2) as shown in the illustrative examples of FIGS. 1 through 7 can comprise a pair of main reflector assemblies (2A)(2B) which unfurl from the stowed condition (4A)(4B) in opposite outward direction from the vehicle bus (5) toward the deployed condition (5A)(5B) to corresponding support a pair of reflectors (11A)(11B). Each of the pair of main reflector assemblies (2A)(2B) can include one or more arcuate or tubular booms (12) (also referred to a "booms") having boom first ends (13) fixedly coupled to a main reflector deployer assembly (7) and a boom medial portion (14) extending through one or more intermediate bulkheads (16) with boom second ends (15) fixedly coupled to a terminal bulkhead (17). While particular examples of the main reflector assembly (2) are shown or described as cylindrical, parabolic, cylindrical parabolic, this is not intended to preclude embodiments which are flat or otherwise arcuate. Additionally, while particular embodiments may be shown or described as having a passive reflector, this is not intended to preclude embodiments in which having an active reflector or active array reflector.

Figure 4:
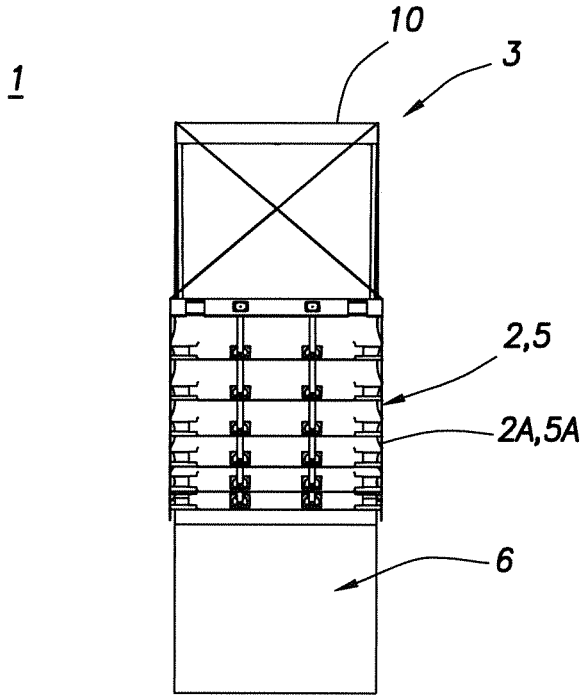
FIG. 4 is a first end elevation view of the antenna in the deployed condition having a second net removed to present the underlying booms extending through a plurality of intermediate bulkheads and coupled to the terminal bulkhead of a first of a pair of main reflector assemblies.
Figure 5:
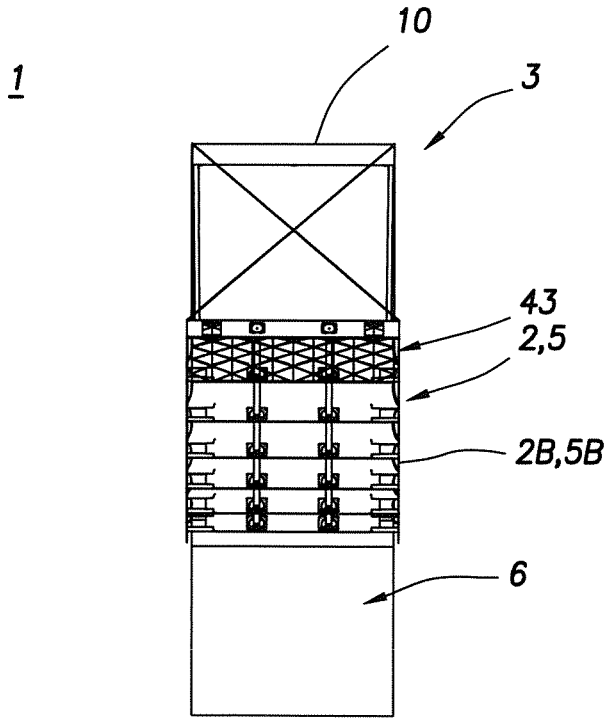
FIG. 5 is a second end elevation view of the antenna in the deployed condition having a portion of the second net attached between one of a plurality of intermediate bulkheads and the terminal bulkhead of a second of a pair of main reflector assemblies.
Figure 6:
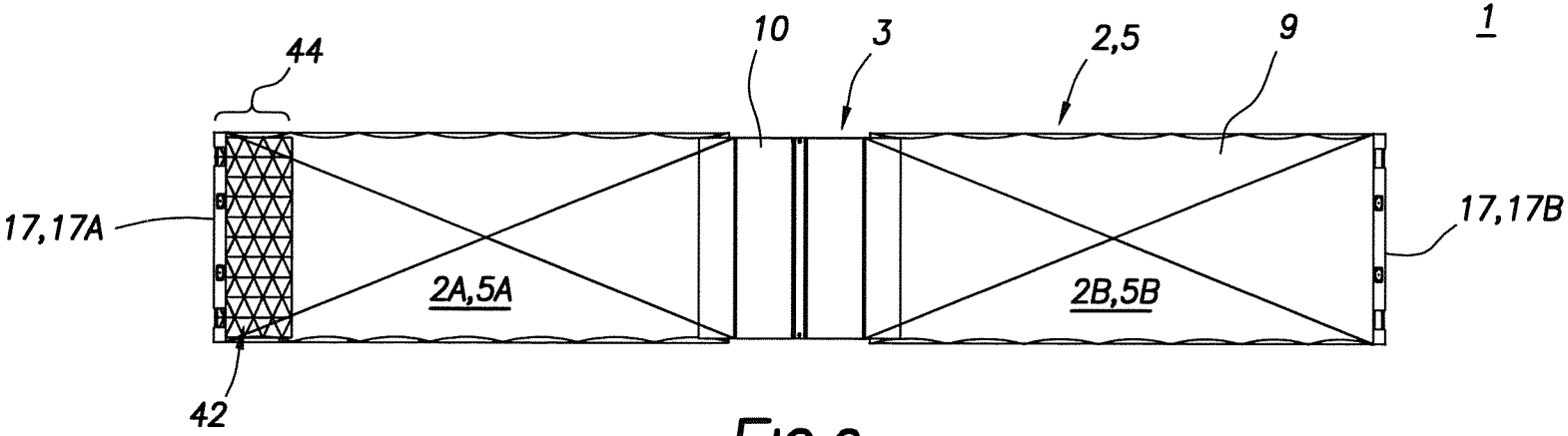
FIG. 6 is a top plan view of the antenna in the deployed condition having a portion of the reflector removed to present an underlying first net which supports and tensions one of the pair of main reflector assemblies.
Figure 7:
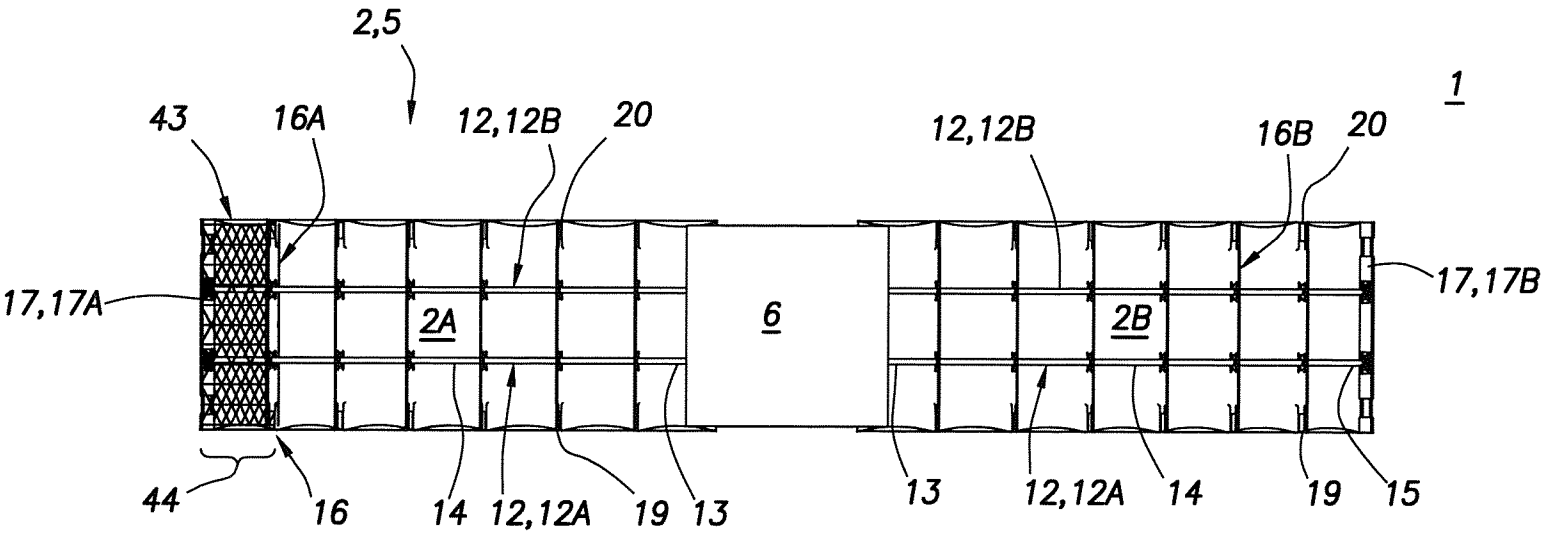
FIG. 7 is a bottom plan view of the antenna in the deployed condition having a portion of the second net attached between one of a plurality of intermediate bulkheads and the terminal bulkhead of a second of a pair of main reflector assemblies.
Figure 8:
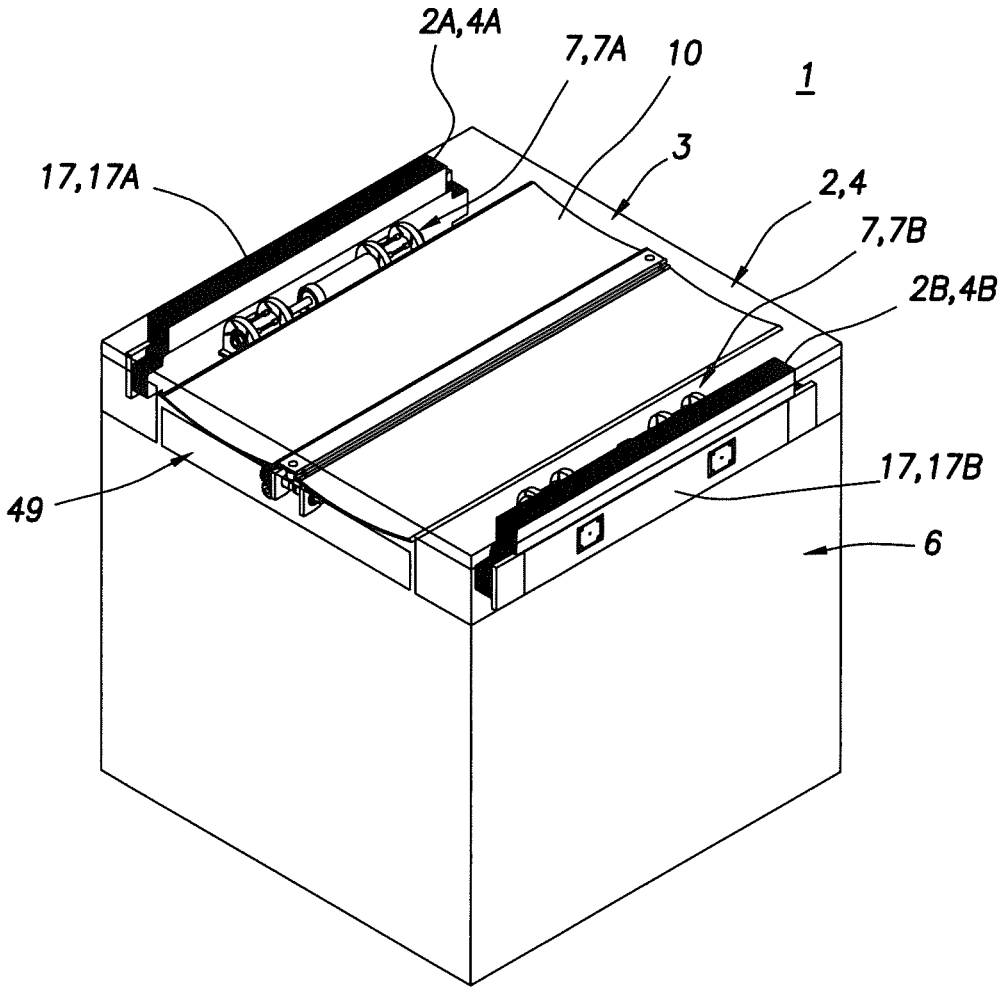
FIG. 8 is a perspective view of the inventive antenna in the stowed condition.
Figure 9:
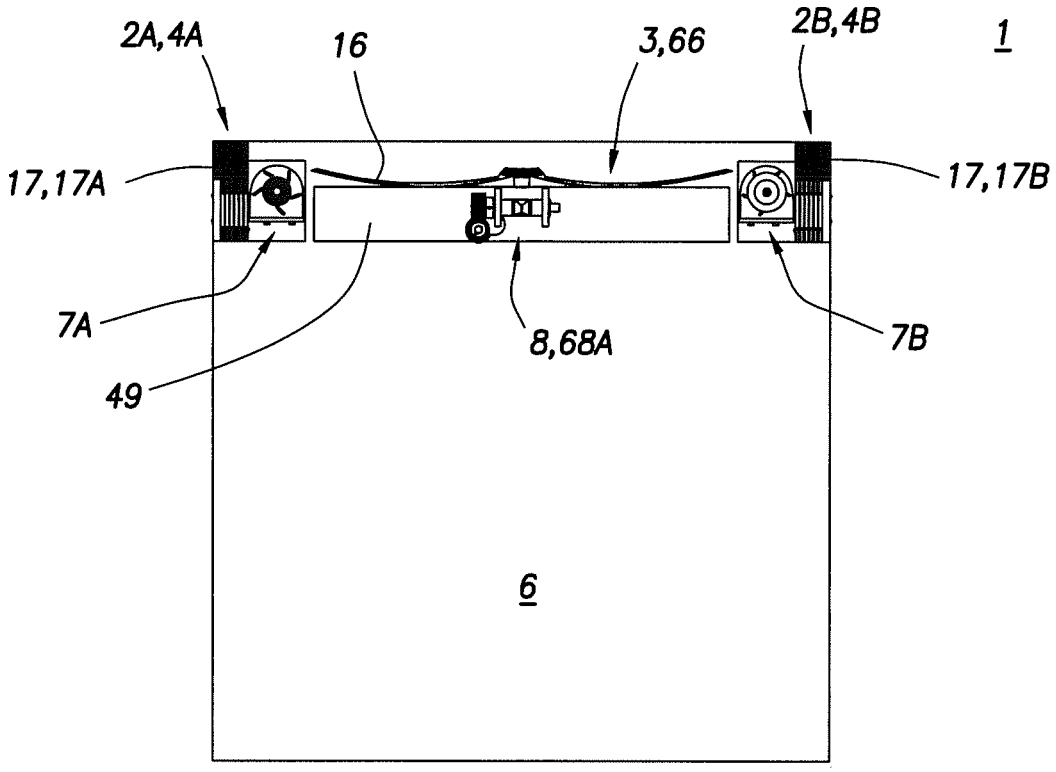
FIG. 9 is first side elevation view of the antenna in the stowed condition.
Figure 10:
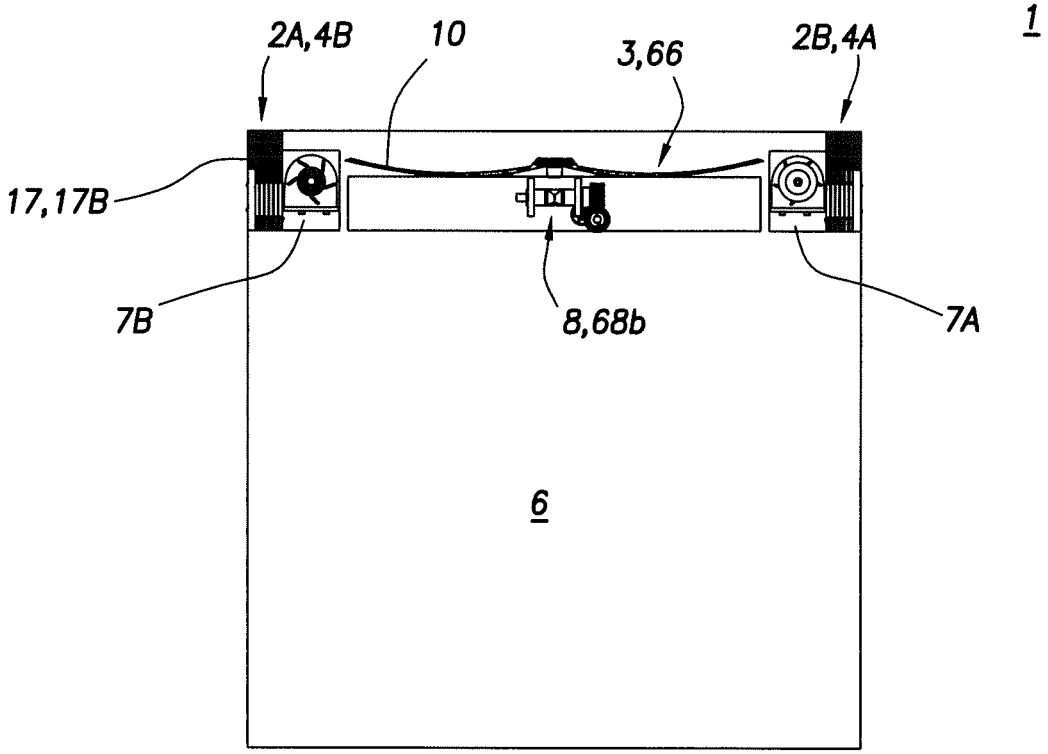
FIG. 10 is second side elevation view of the antenna in the stowed condition.
Figure 11:
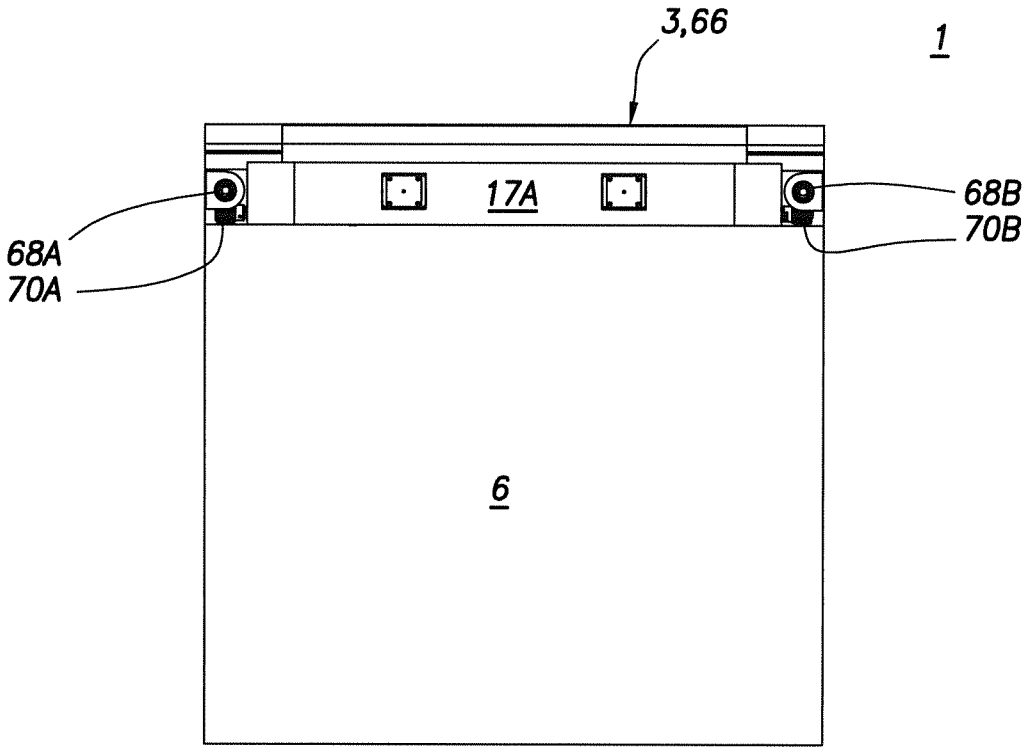
FIG. 11 is a first end elevation view of the antenna in the stowed condition.
Figure 12:
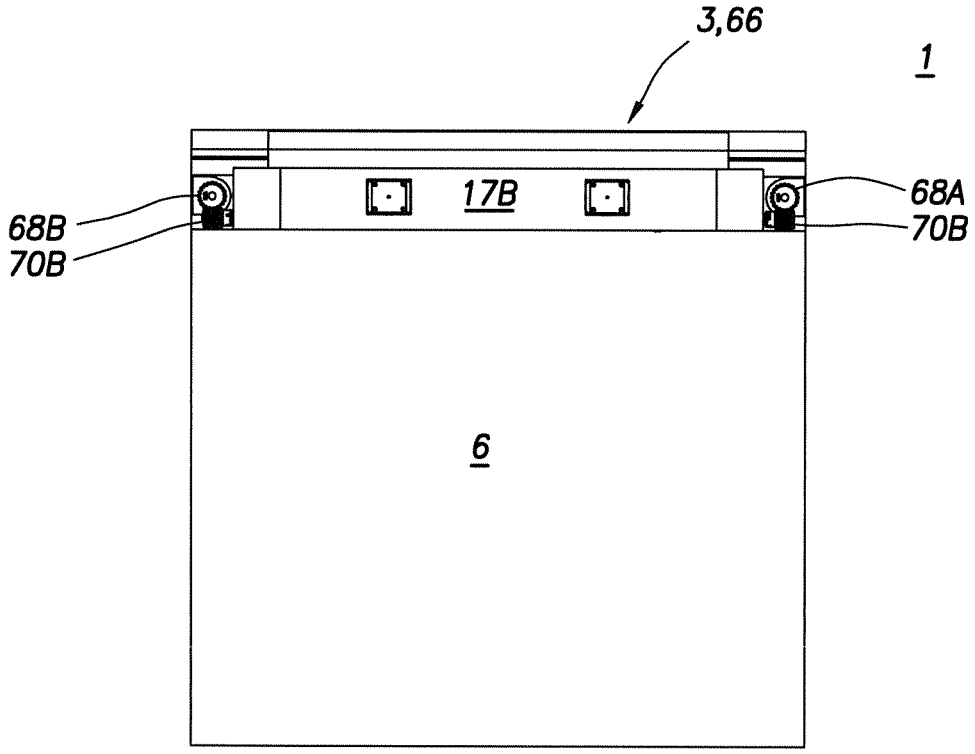
FIG. 12 is a second end elevation view of the antenna in the stowed condition.
Figure 13:
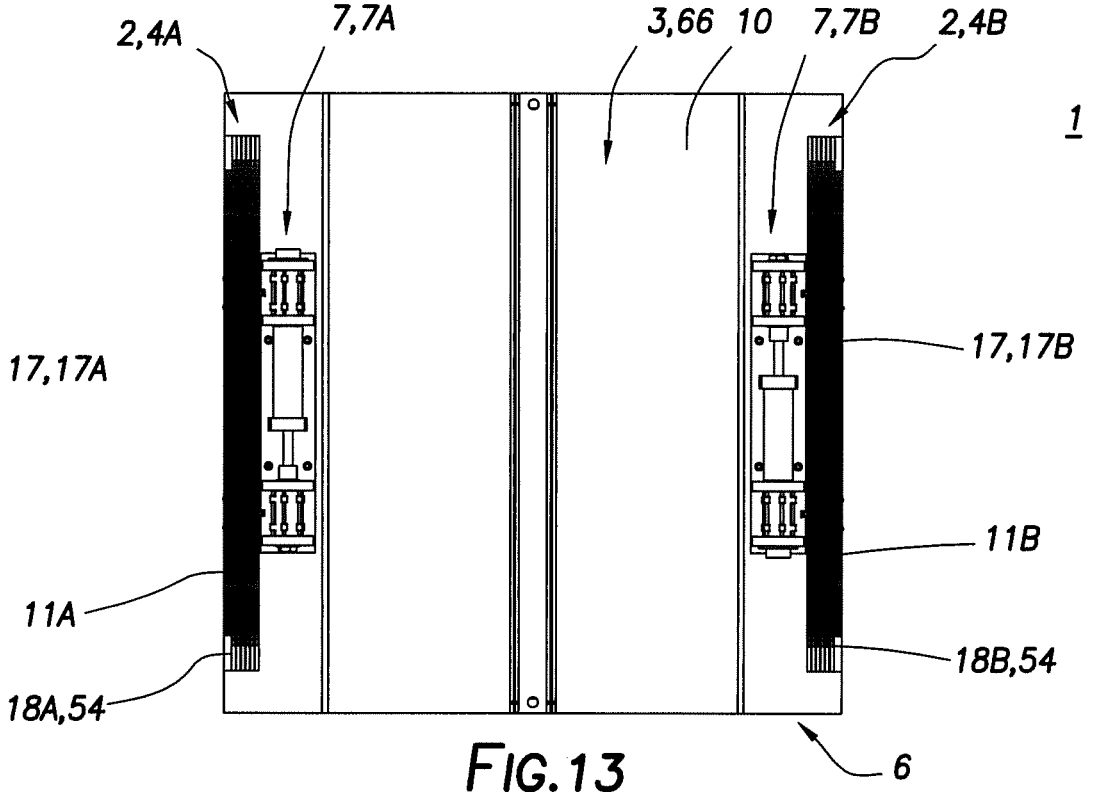
FIG. 13 is a top plan view of the antenna in the stowed condition.

In the illustrative example of FIGS. 4, 5 and 7, each of the pair of main reflector assemblies (2A)(2B) includes a pair booms (12A)(12B) correspondingly deployed by operation one of a pair main reflector deployer assemblies (7A)(7B) which results in translation of a pair of terminal bulkheads (17A)(17B) of the pair of main reflector assemblies (2A)(2B) toward the deployed condition (5A)(5B) and disposes one or more intermediate bulkheads (16A)(16B) in spaced apart relation between one of the terminal bulkheads (17A)(17B) and the corresponding one of the pair main reflector deployer assemblies (7A)(7B).

Now, referring primarily to FIGS. 2 through 3 and 15 through 17, one or more longeron cords (18) can interconnect bulkhead first ends (19) or bulkhead first sides (38) of a terminal bulkhead (17) and one or more intermediate bulkheads (16), and one or more longeron cords (18) can interconnect bulkhead second ends (20) or bulkhead second sides (39) of the terminal bulkhead (17) and the one or more intermediate bulkheads (16). In particular embodiments, a pair of longeron cords (18A)(18B) can be coupled in spaced apart relation on each bulkhead first end (19) or bulkhead second end (20), or bulkhead first or second sides (38)(39), or combinations thereof, and each longeron cord (18A)(18B) can be tensioned by translation of the terminal bulkheads (17A)(17B) toward respective deployed condition (5A)(5B).

In particular embodiments, one or more diagonal cords (21) can be diagonally interconnect bulkhead first ends (19) or bulkhead second ends (20) of adjacent terminal bulkhead (17) or intermediate bulkheads (16) (as shown in the illustrative example of FIG. 17) or diagonally interconnect bulkhead first or second sides (38)(39) (as shown in the illustrative example of FIG. 6) to transfer the loads acting on the terminal bulkhead (17) or intermediate bulkheads (16) to increase axial and lateral stiffness in the main reflector assemblies (2A)(2B). The longeron cords (18) and diagonal cords (21) can be of any natural or synthetic pliant strips, filaments, or strands, whether one-piece, woven or braided, and suitable longeron cords (18) or diagonal cords (21) can comprise as illustrative examples, one or more: of a liquid crystal polymer such as: Vectran®, Kevlar®, Zenite® polyester, polypropylene, polyethylene; carbon fiber; or metals such as: aluminum, stainless steel, nickel, copper, or combinations thereof.

The Booms. Now, referring primarily to FIGS. 4, 5, 7, 15 and 19, each of the one or more booms (12) can, but need not necessarily, comprise an arcuate slit tube (12'). In the illustrative examples, the arcuate slit tube (12') comprises a composite laminate which can be formed about an arcuate mandrel. In particular embodiments, the composite laminate can have one more outer layers comprised of quartz fibers pre-impregnated with thermoset polymer and one or more inner layers comprised of uniaxial intermediate modulus carbon fibers pre-impregnated with thermoset polymer. The resulting arcuate slit tube (12') can have a deployed outside diameter of about 1.5 inches, a wall thickness of about 0.017" and an axial modulus of about 10 megapounds per square inch ("mpsi") (similar to aluminum). The laminate can be bi-stable which resists blooming when wound and resists winding when unwound and can hold the arcuate configuration of the boom (12) under gravity without additional support when deployed. However, the illustrative example of the boom as an arcuate slit tube is not intended to preclude embodiments of a slit tube (12') having other dimensional relations, such as an arcuate boom having an arc in the deployed condition encompassing a greater or lesser degree angle, for example between, or the use of slit tube extendable members, bistable-reelable composites, or coiled composite masts, produced from other materials or combinations of materials, such as: metal, carbon fiber, or metal and composite laminate, or by other methods of fabrication, such as, injection molding, blow molding or extrusion molding, or combinations thereof.

The Boom Intermediate Bulkhead Interface. Now referring primarily to FIGS. 15 and 19, in particular embodiments, each intermediate bulkhead (16) can further include an intermediate bulkhead boom interface (22). The boom (12) can slidingly engage the intermediate bulkhead boom interface (22) during and after deployment of the main reflector (2) to resist boom buckling and boom roll and provides a surface which aids in boom strain recovery. In the illustrative example shown in the Figures, each intermediate bulkhead (16) can, but need not necessarily, afford an aperture periphery (23) defining a boom passthrough (24). The intermediate bulkhead boom interface (22) can comprise a boom interface annular member (25) suspended by a boom interface neck (26) within the boom passthrough (24). The boom internal surface (27) can slidingly engage an annular member periphery (28) with the boom interface neck (26) extending through a tube slit (29). In particular embodiments, the boom interface annular member (25) can, but need not necessarily, include a first roller element (30) rotationally coupled to the boom interface annular member (25) opposite the boom interface neck (26) and which rotationally engages the boom internal surface (27). In particular embodiments, a second roller element (31) can, in opposed relation to the first roller element (30), rotationally engage the boom external surface (32). The second roller element (31) can be springingly coupled (33) to the aperture periphery (23) opposite the interface neck (26) to allow the second roller element (31) to correspondingly track the movement, features, or irregularities of the boom external surface (32).

The Boom Terminal Bulkhead Interface. Now referring primarily to FIG. 16, in particular embodiments, each terminal bulkhead (17)(17A)(17B) can, but need not necessarily, include a terminal bulkhead interface (34) which includes one or more of a resilient or springing element or assembly (35) (referred to as "a springing element") and a pivot element or assembly (36) (referred to as "pivot element"). The springing element (35), which can have a low spring rate, compresses to load or tension the longeron cords (20) and diagonal cords (21), while the pivot element (36) acts to prevent torsional or bending moments on the boom (12).

Figure 16:
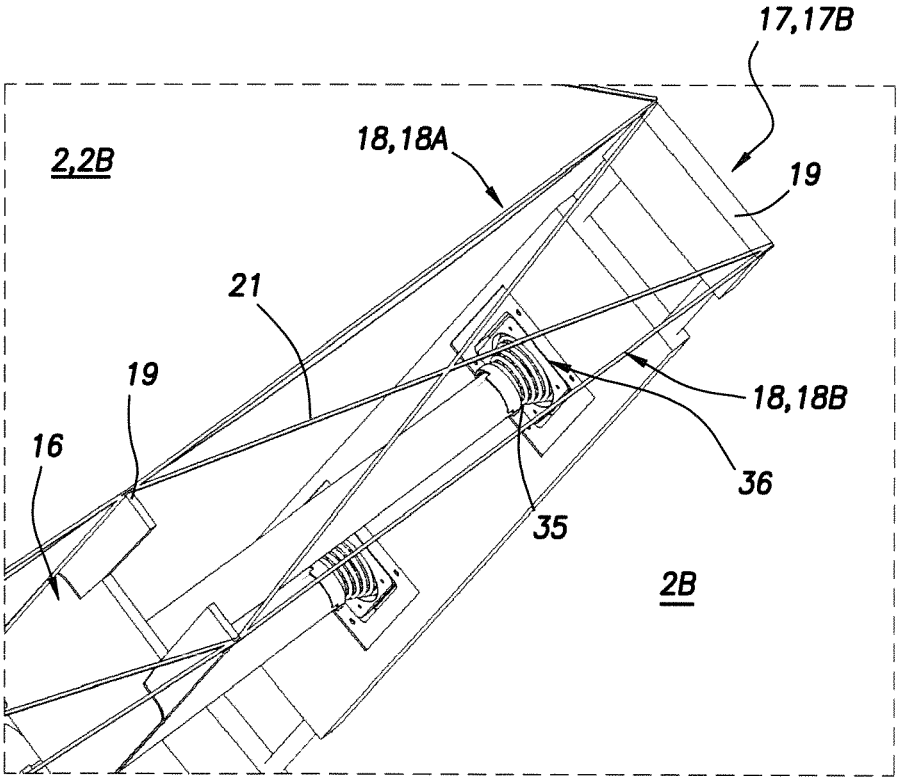
FIG. 16 is a perspective view of an embodiment of a terminal bulkhead interface including a springing element and a pivot element disposed between a boom second end and the terminal bulkhead.
Figure 17:
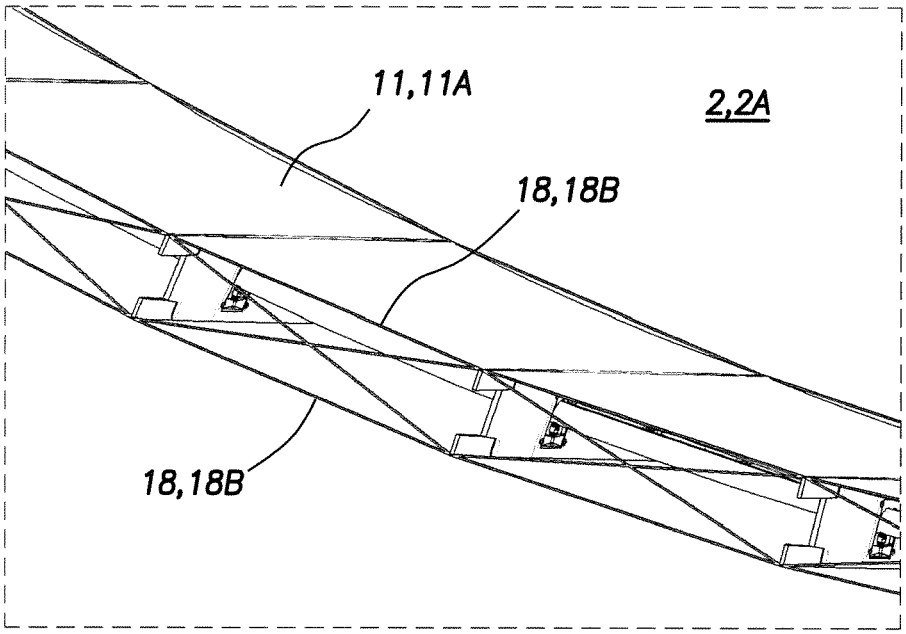
FIG. 17 is an enlarged partial perspective first side elevation view of one of the pair of main reflector assemblies illustrating longeron cords and diagonal cords which interconnect the plurality of intermediate bulkheads.

With primary reference to FIG. 16, in particular embodiments the springing element (35) and the pivot element (36), can but need not necessarily, be disposed between the boom second end (15) and the terminal bulkhead (17). However, this illustrative example is not intended to preclude embodiments of the springing element (35) or the pivot element (36) rotatably coupled at the bulkhead ends (19)(20) or bulkhead sides (38)(39) which directly or indirectly resiliently move to tension the longeron cords (20) or diagonal cords (21) or pivot to prevent torsional or bending moments on the boom (12). As one illustrative example, the terminal or intermediate bulkhead ends (19)(20) may terminate in a resilient hinge assembly which acts upon the longeron or diagonal cords (20)(21) in the deployed condition (5A)(5B) of the main reflector (2).

The Net. Now, referring primarily to FIGS. 4 through 7 and 18, each terminal bulkhead (17) and each of the plurality of intermediate bulkheads (16) can include a bulkhead perimeter (37) defined by a bulkhead first side (38) opposite a bulkhead second side (39) and a bulkhead first end (19) opposite a bulkhead second end (20) joining a first bulkhead face (40) opposite a second bulkhead face (41). In particular embodiments, a first net (42) can be attached to and extend between adjacent bulkhead first sides (38), and in particular embodiments, a second net (43) can be attached to and extend between adjunct bulkhead second sides (39). In particular embodiments, the first and second nets (42)(43) can be first and second net faces of an integral net. In particular embodiments, the first net (42) and the second net (43) can be attached as discreate net sections (44) attached to one more adjacent bulkhead first sides (38) or adjacent bulkhead second sides (39). With reference to FIGS. 1, 4, 5 and 7, only a portion of the first and second nets (42)(43) are illustrated and with particular reference to FIGS. 5 and 7, only one net section (44) of the second net (43) is illustrated and extends between the terminal bulkhead (17) and the immediately adjacent intermediate bulkhead (16) thereby providing a view of the underlying booms (12) and intermediate bulkheads (16) of the main reflector assembly (2A)(2B); however, it is understood that the first and second nets (42)(43) or net sections (44) thereof, can attach to all of the corresponding intermediate bulkhead first or second sides (38)(39). The first and second nets (42)(43) can in the deployed condition (5A)(5B) of the main reflector assemblies (2A)(2B) maintain a first net outer surface (45) (as shown in the illustrative example of FIGS. 1 and 6) having parabolic configuration to support a corresponding reflector (11A)(11B) to provide a main reflector (2) having frequency capability to the Ka band.

The Tension Ties. Now, referring primarily to FIG. 18, the first net (42) and the second net (43) of each of the main reflector assemblies (2A)(2B) can, but need not necessarily, be attached to each other by a plurality of tension ties (46) extending between the first and second net (42)(43) and in particular embodiments between opposite net polyhedron vertices (47) (an illustrative portion of the plurality of tension ties shown in the example of FIG. 18). The plurality of tension ties (46) can aid in achieving the parabolic first net outer surface (45) to support the reflector (11A)(11B) in a configuration to achieve the frequencies, directivities or gains described herein.

The Reflector. Again, referring primarily to FIGS. 1, 16, 17 and 18, embodiments can further include a reflector (11)(11A)(11B) disposed on or over the first net (42) of the main reflector assemblies (2A)(2B). The reflector (11)(11A)(11B) can receive and reflect electromagnetic waves including as illustrative examples radio waves, microwaves, infrared, visible light, ultraviolet light, X-rays, and gamma rays (also referred to as the "signal (48)"). The reflector (11)(11A)(11B) supportingly configured by each of the pair of main reflector assemblies (2A)(2B) can receive and reflect the signal (48) to or from a feed (49) (as shown in FIG. 1A) or to or from a sub-reflector (3) and the feed (49). The term "feed" is intended to generically encompass any emitter, and as illustrative examples encompasses, but is not limited to: feed arrays, patch arrays, feed horns, or the like As to certain embodiments, the reflector (11) can be integrated or one-piece with the first net (42) or supportingly overlaying the first net (42) of the pair of main reflector assemblies (2A)(2B). The pair of main reflector assemblies (2A)(2B) including the reflector (11) can, but need not necessarily, be configured to provide a parabolic cylindrical reflector surface (9) defining a reflector aperture (50) of about 1 m×5 meters (or therebetween scaled in increments of 50 millimeters ("mm")); however, this is not intended to preclude embodiments which define a lesser or greater reflector aperture (50).

The Ka Band Mesh. Again, referring primarily to FIGS. 1, 16, 17 and 18, the pair of main reflector assemblies (2A)(2B) can, but need not necessarily, utilize a mesh reflector (11) capable of receiving and reflecting wavelengths having frequencies up to 36 GHz. Embodiments, of the mesh reflector (11)(11A)(11B) can, but need not necessarily, include about 30 openings per inch ("opi") to about 40 opi; although, embodiments can include an opi occurring in a broader range of between about 20 opi and about 50 opi. However, this illustrative example of a mesh reflector (11) is not intended to preclude the use of reflector materials, reflecting materials or reflecting surfaces such reflective knitted mesh, reflective membrane, active or passive reflectarray, rigid reflective panels, phased array panels, or the like.

The Ka Band Mesh Reflector. Again, referring primarily to FIGS. 1, 16 through 18, and 24, the pair of main reflector assemblies (2A)(2B) can, but need not necessarily, utilize a mesh reflector (11) proven in repeated deployment to maintain a reflector surface (9) having measured HLPE of less than 0.428 mm and remained suitable to receive and reflect frequencies up to 36 GHz. Testing resulted in a directivity of 49.95 decibels ("dB") with a half power beam width ("HPBW") of 0.57 degrees ("θ") and 0.53 θ in the E and H plane respectively. Theoretical performance of the mesh reflector (11) placed directivity at 50.03 dB with a HPBW of 0.58 θ and 0.59 θ in the E and H plane respectively. In addition to operating at close the theoretical levels of directivity the reflector (2) has good gain performance with total gain of 49.18 dB at 35.57 GHz with an efficiency of 59.42%. These results demonstrate the deployment precision and performance capabilities in embodiments of the main reflector (2).

The Main Reflector Assembly Deployer. Now referring primarily to FIGS. 19 through 22, embodiments, can further include a main reflector deployer assembly (7). In particular embodiments, the a main reflector deployer assembly (7) can, but need not necessarily include, a pair of main reflector assembly deployers (7A)(7B) each operable to rotate a pair of spools (51A)(51B) which correspondingly stow each of a pair of booms (12A)(12B) in a substantially flat wound condition (52) on each of the pair of spools (51A)(51B) and deploy the pair of booms (12A)(12B) as arcuate or arcuate slit tube (12') to move the pair of main reflectors (12A)(12B) from the stowed condition (4A)(4B) as shown in the examples of FIGS. 8 through 14 to the deployed condition (5A)(5B) as shown in the examples of FIGS. 1 through 7.

Figure 14:
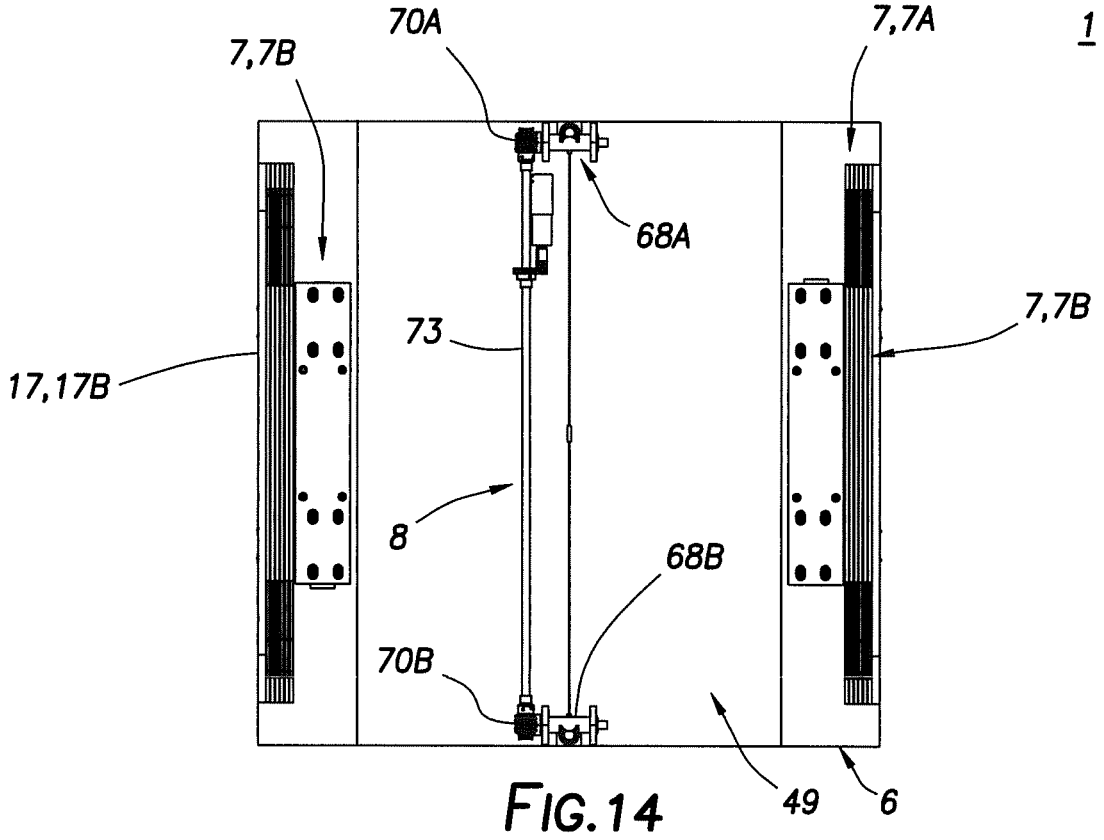
FIG. 14 is a bottom plan view of the antenna in the stowed condition.
Figure 15:
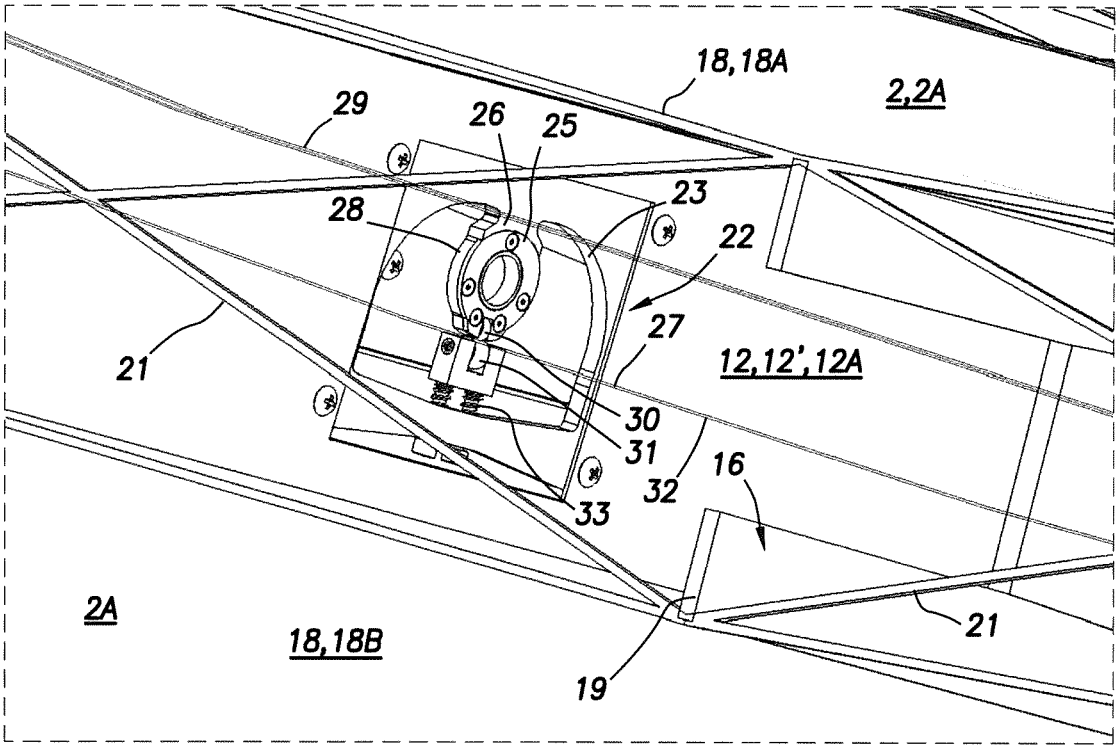
FIG. 15 is a perspective view of an embodiment of an intermediate bulkhead interface attached to an intermediate bulkhead of one of the pair of main reflector assemblies which bulkhead interface slidingly engages a boom during deployment of the main reflector.
Figure 18:
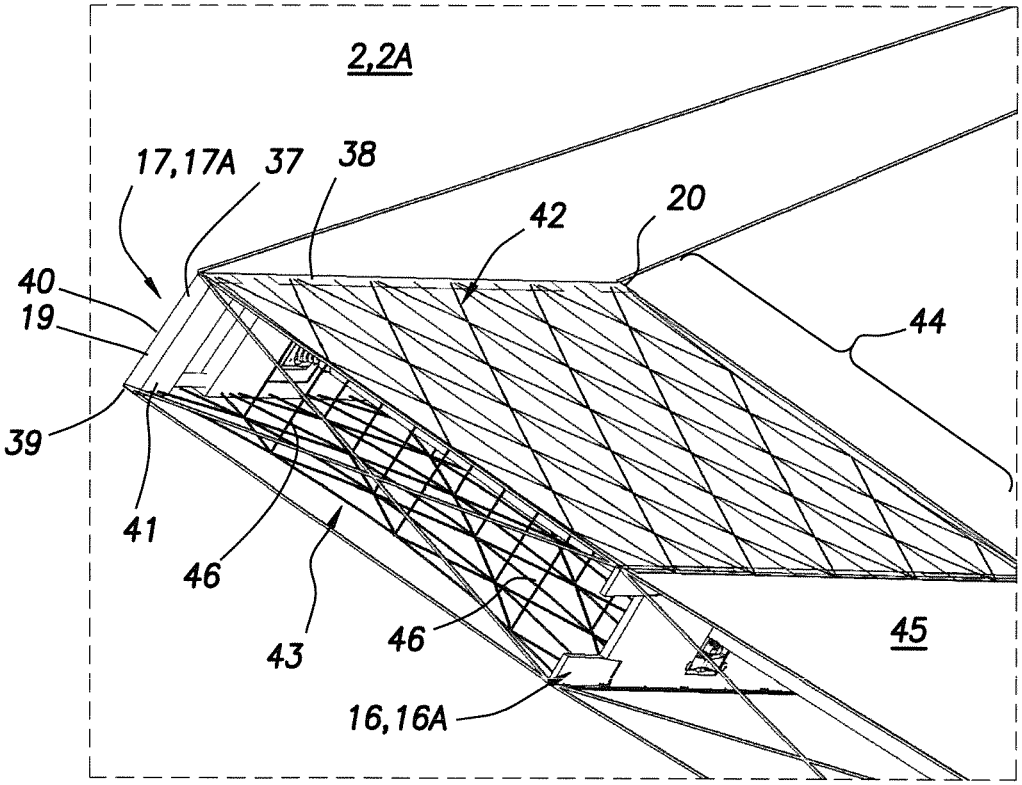
FIG. 18 is an enlarged partial perspective first side elevation view of one of the pair of main reflector assemblies illustrating the first and second nets coupled to opposed edges of the intermediate bulkheads and terminal bulkheads and tensioning ties which interconnect the first and second nets.
Figure 19:
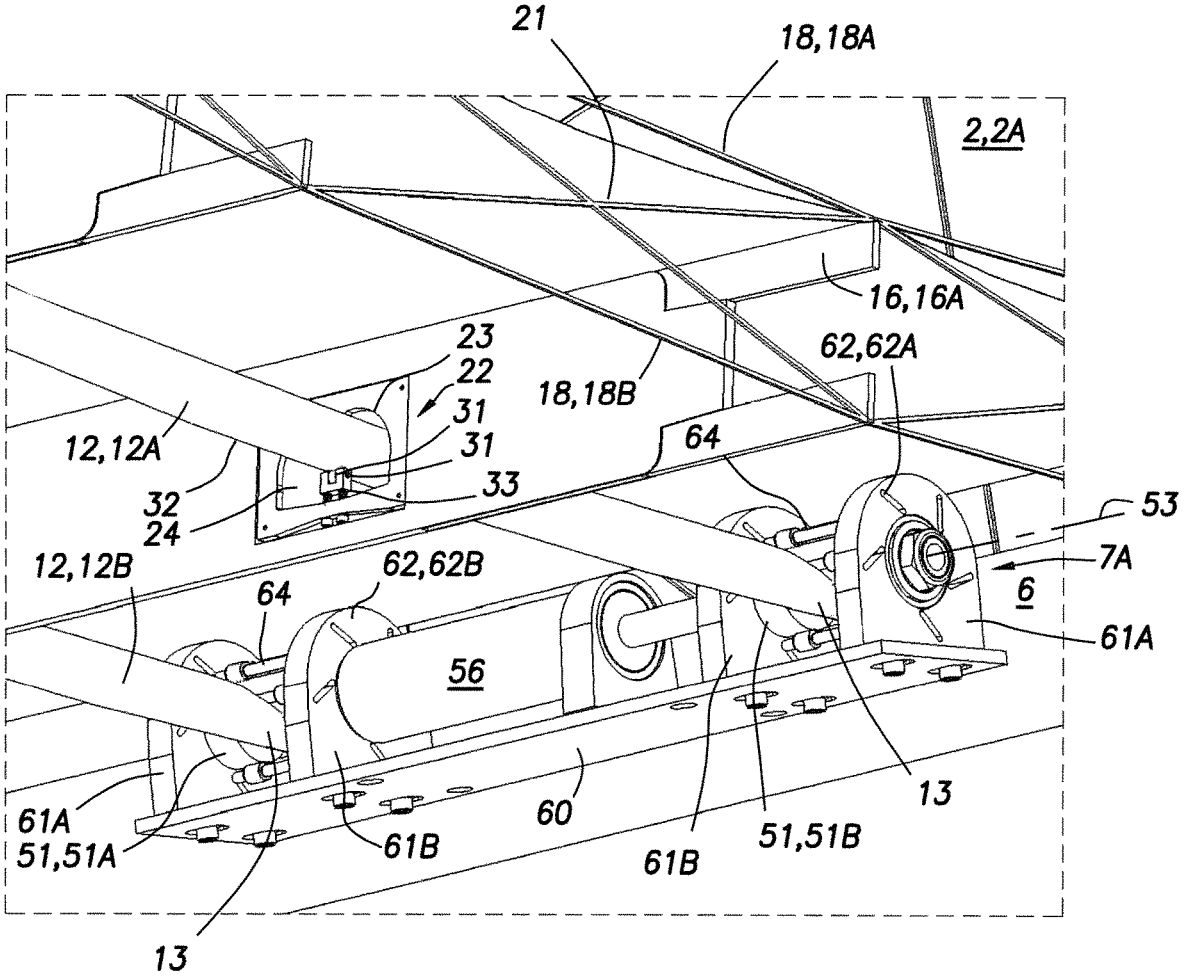
FIG. 19 is a perspective view of an embodiment of a first of a pair of main reflector assembly deployers operable to rotate a plurality of spools which correspondingly stow a plurality of booms in a substantially flat wound condition and deploy the plurality of booms as an arcuate slit tube.
Figure 20:
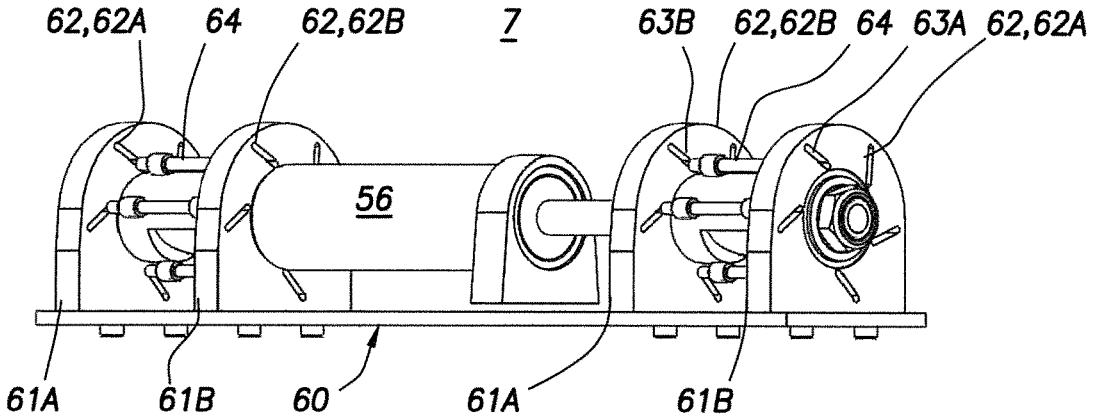
FIG. 20 is a perspective view of a first of a pair of main reflector assembly deployers.
Figure 21:
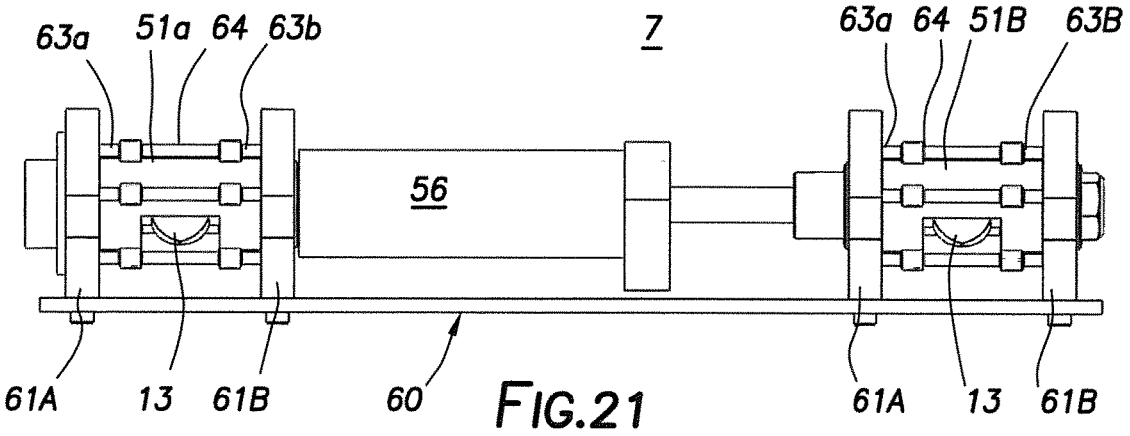
FIG. 21 is a first side elevation view of the first of the pair of main reflector assembly deployers.
Figure 22:
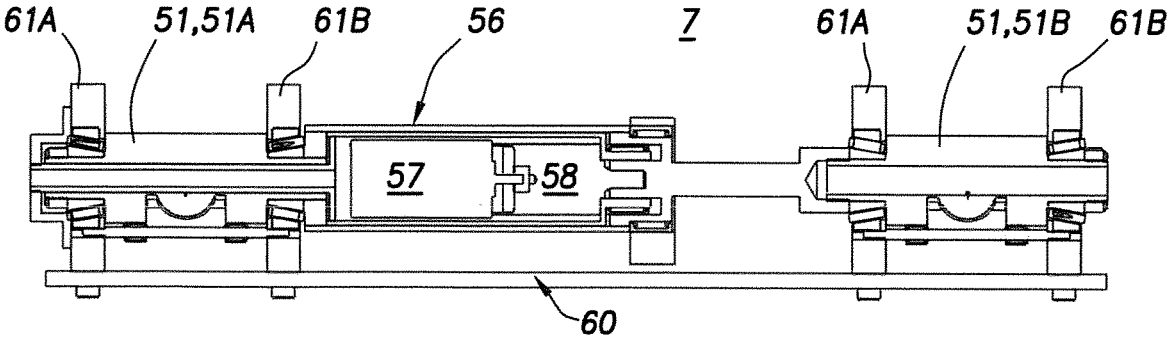
FIG. 22 is a cross section view 21-21 as shown in FIG. 22.

Again, referring primarily to FIGS. 19 through 22, in particular embodiments, each of the pair of spools (51A)(51B) each reversibly rotate about a spool longitudinal axis (53) to correspondingly reversibly wind each of the pair of booms (12A)(12B) about a corresponding one of the pair of spools (51A)(51B) to extend and retract one of the pair of terminal bulk heads (17). Extension of the terminal bulkhead (17) tensions the corresponding longeron cords (18) and diagonal cords (21) to move the plurality of intermediate bulkheads (16) from close or abutting adjacent spatial relation as shown in the example of FIGS. 18 through 14 in which the corresponding first and second nets (42)(43), reflector (11) and associated longeron cords (18) and diagonal cords (21) can be disposed in a relaxed or untensioned condition (54) toward the deployed condition (5) of the main reflector assembly (2A)(2B) disposing the plurality of intermediate bulkheads (16) in spaced apart adjacent relation as shown in the example of FIGS. 4 through 7 and 17 in which the corresponding first and second nets (42)(43), reflector (11) and associated longeron cords (18) and diagonal cords (22) can be disposed in the tensioned conditioned (55). In particular embodiments, each of the pair of spools (51A)(51B) can be rotatably driven in common by a drive assembly (56) including one or more of a motor (57) which can be coupled to a gearbox (58) which acts to transmit and control application of power from the motor (57) to a pair of drive shafts (59) correspondingly coupled one of the pair of spools (51A)(51B). The pair of spools (51A)(51B) and the drive assembly (56) can be spatially fixed to a deployer base (60) corresponding spatially fixed to the vehicle bus (6). The pair of main reflector deployers (7A)(7B) spatially fixed to the vehicle bus (6) operate to the extend the pair of main reflector assemblies (2A)(2B) in opposite direction to dispose the main reflector (2) in the deployed condition (5).

Again, referring to FIGS. 19 through 22, in particular embodiments, each spool (51) can be journaled in and rotate about the spool longitudinal axis (53) between a pair of stationary end pieces (61A)(61B) each of which can include a plurality of slots (62) circumferentially spaced about and radially outwardly extending from the spool longitudinal axis (53). The plurality of slots (62) in the pair of stationary end pieces (61A)(61B) can be aligned in opposite relation, each of the pair of slots (62A)(62B) can be aligned in opposite relation and each aligned pair of slot can correspondingly receive a pair of boom presser ends (63A)(63B) to dispose a plurality of boom pressers (64) circumferentially about each spool (51). As a boom (12) winds about or unwinds from a spool (51), each pair of boom presser ends (63A)(63B) can move in the corresponding pair of slots (62A)(62B) to maintain engagement of each of the plurality of boom pressers (64) with the boom (12) wound on the spool (51).

Figure 23:
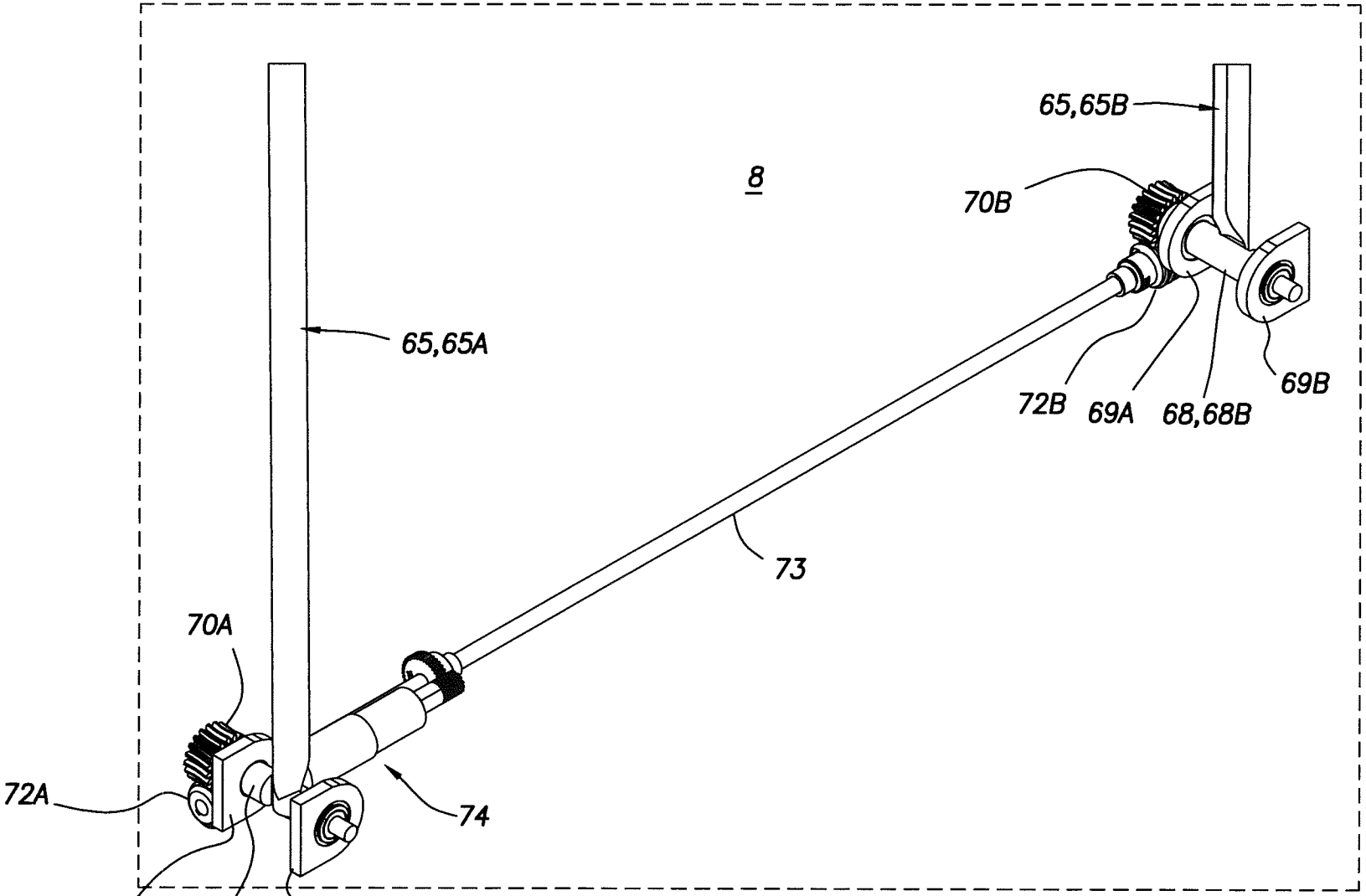
FIG. 23 is a perspective view of an embodiment of a sub-reflector deployer.

The Feed Or Sub-Reflector Assembly. Now referring primarily to FIGS. 1A and 1B through 14 and 23, embodiments of the antenna (1) can optionally include a deployable feed (49) (as shown the example of FIG. 1A) or a deployable sub-reflector (3) (as shown in the example of FIG. 1B) and secondary deployer assembly (8) operable to dispose the feed (49) in spatial relation to the main reflector (2), or dispose the sub-reflector (3) in spatial relation to the main reflector (2) and a feed array (49) located in the vehicle bus (6). Now, with primary reference to the example of FIGS. 1B and 8 through 10 and 23, the sub-reflector (3) can move by extension and retraction of one or more secondary arcuate or tubular booms (65) (also referred to as "secondary booms") from a sub-reflector stowed condition (66) disposed in abutting adjacent relation or adjacent relation over the feed array (49) having a stationary position in the vehicle bus (6) and a sub-reflector deployed condition (67) disposed a distance from the feed array (49) by operation of the secondary deployer assembly (8) which extends the secondary boom(s) (65) by unwinding each of a pair of secondary booms (65A)(65B) from about a corresponding pair of secondary boom spools (68A)(68B) (as shown in the example of FIG. 23) to dispose the sub-reflector (3) at a distance which focuses the signal (48) to or from the feed array (49). Now, with primary reference to the example of FIG. 1A and FIGS. 8 through 10 and 23, in particular embodiments, the sub-reflector (3) can be omitted, and the feed (49) can move by extension and retraction of one or more secondary booms (65) from a feed stowed condition from a location in the vehicle bus (6) (the sub-reflector (3) being omitted) and a feed deployed condition (as shown in FIG. 1A) disposed a distance from the vehicle bus (6) by operation of the secondary deployer assembly (8) which extends the secondary boom(s) (65) by unwinding each of a pair of secondary booms (65A)(65B) from about a corresponding pair of secondary boom spools (68A)(68B) (as shown in the example of FIG. 23) to dispose the feed (49) at a distance which focuses the signal (48) to or from the main reflector (2).

Now, referring primarily to FIG. 23, in particular embodiments the secondary boom spools (68A)(68B) can each rotatingly journaled in and between a pair of stationary end pieces (69A)(69B). A pair of worm gears (70A)(70B) can be correspondingly coupled to each spool end (71A)(71B) and the secondary boom spools (68A)(68B) correspondingly rotated by rotation of the pair of worm gears (70A)(70B). A pair of worms (72A)(72B) can be disposed at the ends of a worm drive axle (73) and correspondingly engage the pair of worm gears (70A)(70B). A worm drive (74) can operate to rotate the worm drive axle (73) to correspondingly rotate the pair of worms (72A)(72B) and correspondingly the pair of worm gears (70A)(70B) and the pair of secondary boom spools (68A)(68B) to wind and unwind the pair of secondary booms (65A)(65B) to move the feed (49) or the sub-reflector inward or outward of main reflector (2).

Figure 24:
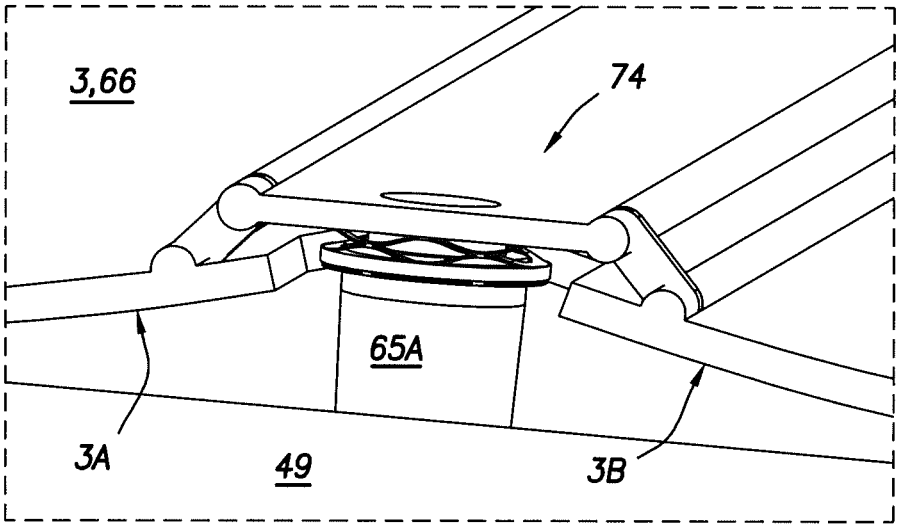
FIG. 24 is perspective end view of an embodiment of a sub-reflector hinge assembly in a sub-reflector stowed condition.
Figure 25:
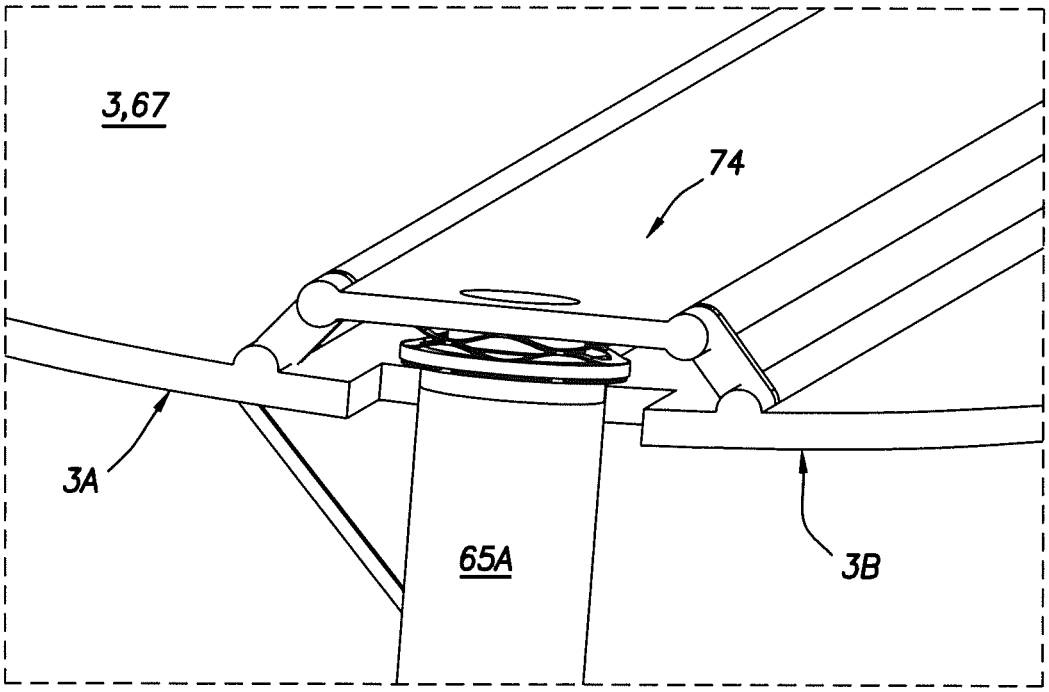
FIG. 25 is perspective end view of an embodiment of a sub-reflector hinge assembly in a sub-reflector deployed condition.

Now, referring primarily to FIGS. 24 and 25, in particular embodiments the sub-reflector (3) can, but need not necessarily, include a hinge assembly (74) medially disposed between a pair of sub-reflectors (3A)(3B) allowing each of the pair of sub-reflectors (3A)(3B) to move from the sub-reflector stowed condition (66) in which the pair of sub-reflectors rotate toward a flattened configuration as shown in FIGS. 8 through 10 and 24 toward the sub-reflector deployed condition (67) in which the pair of sub-reflectors rotate toward an arcuate configuration as shown in FIGS. 1 through 3 and 25.

Figure 26A:
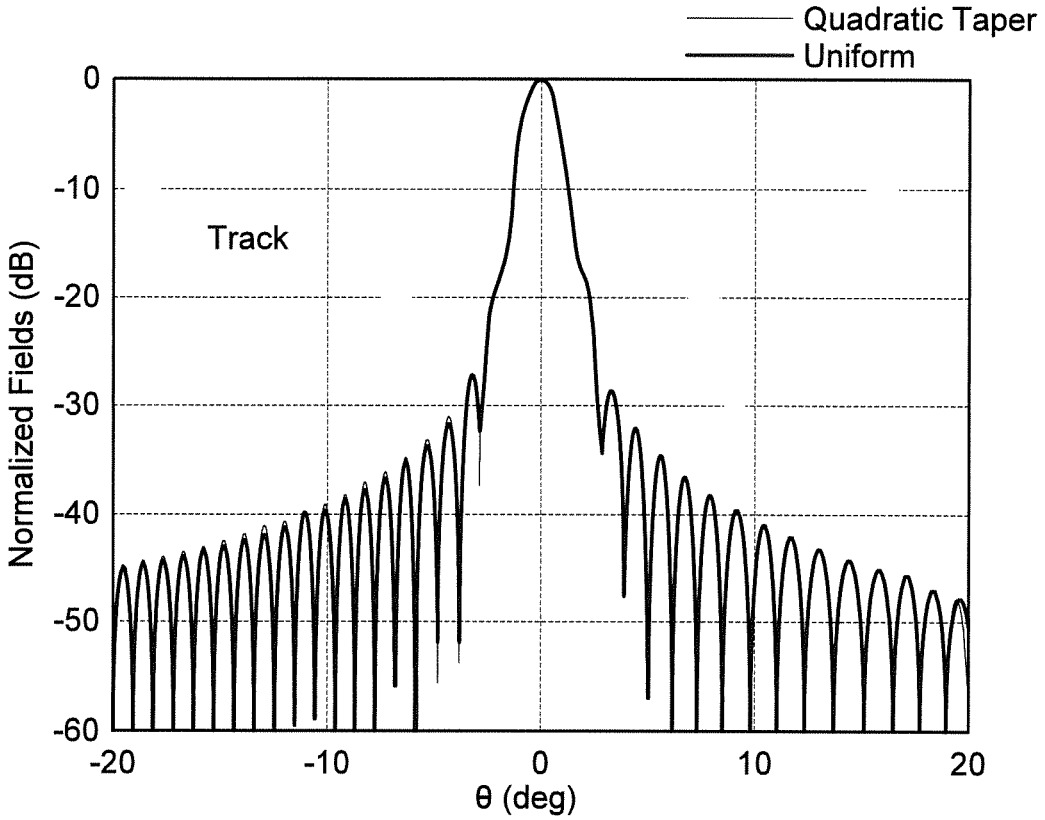
FIG. 26A is a plot of radiation patterns of a single offset reflector configuration in the plane of the track (XZ plane) when all the elements of an exciter are given uniform excitation and when there is a quadratic amplitude taper along the focal line of the parabola.
Figure 26B:
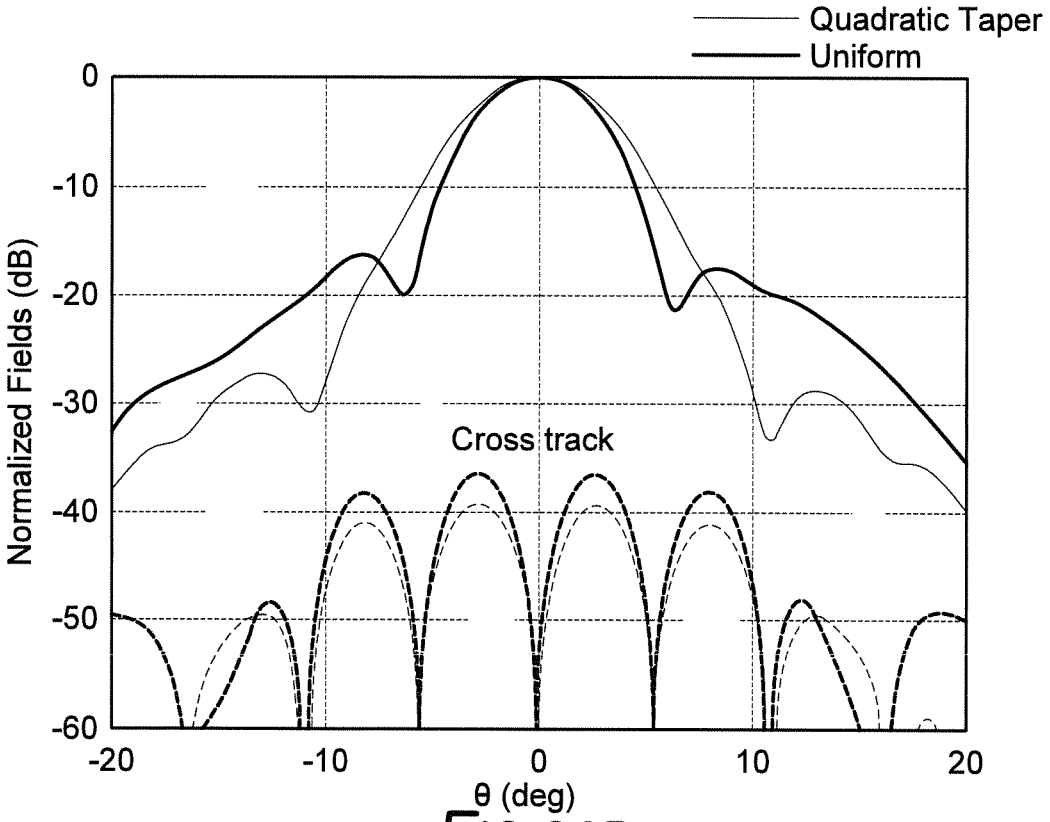
FIG. 26B is a plot of radiation patterns of a single offset reflector configuration along the cross track (YZ plane) when all the elements of an exciter are given uniform excitation and when there is a quadratic amplitude taper along the focal line of the parabola.

Now referring primarily to FIGS. 26A and 26B which include radiation patterns of a single offset reflector configuration in (a) plane of the track (XZ plane) (FIG. 26A) and (b) along cross track (YZ plane) (FIG. 26B) in which all the elements of the feed are given a uniform excitation and when there is a quadratic amplitude taper provided along the focal line of the parabola.

A comparison of directivity and beam width in which all the elements of the feed are excited uniformly versus the case where the amplitude is tapered is set forth in Table 1.

TABLE 1

| | Quadratic | Uniform |
|---|---|---|
| Directivity | 35.66 dB | 35.74 dB |
| HPBW (E-plane) | 1.54° | 1.54° |
| HPBW (H-plane) | 6.04° | 5.37° |

As can be easily understood from the foregoing, the basic concepts of the present invention may be embodied in a variety of ways. The invention involves numerous and varied embodiments of an antenna and methods for making and using such antenna including the best mode.

As such, the particular embodiments or elements of the invention disclosed by the description or shown in the figures or tables accompanying this application are not intended to be limiting, but rather illustrative of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "reflector" should be understood to encompass disclosure of the act of "reflecting"—whether explicitly discussed or not—and, conversely, were there effectively disclosure of the act of "reflecting", such a disclosure should be understood to encompass disclosure of a "reflector" and even a "means for reflecting." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in Merriam-Webster's Collegiate Dictionary, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the antenna herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

What is claimed is:

1. An antenna, comprising:

a pair of booms disposed side by side in substantially parallel relation each having a length disposed between a boom first end and a boom second end;

a plurality of bulkheads including a terminal bulkhead coupled to said boom second ends and a plurality of intermediate bulkheads slidably disposed in spaced apart adjacent relation along said length of said pair of booms between said boom first ends and said boom second ends; and a reflector supported by said plurality of bulkheads.

2. The antenna of claim 1, further comprising a pair of boom passthroughs disposed in each of said plurality of intermediate bulkheads, said pair of boom passthroughs defining a pair bulkhead apertures disposed in each of said plurality of bulkheads, one of said pair of booms passing through a corresponding one of said pair of bulkhead apertures.

3. The antenna of claim 2, further comprising a first net coupled to said plurality of bulkheads on bulkhead first sides and a second net coupled to said plurality of bulkheads on bulkhead second sides, said first net supporting said reflector.

4. The antenna of claim 3, further comprising a plurality of ties interconnecting said first and second nets.

5. The antenna of claim 4, further comprising:

a first longeron cord interconnecting bulkhead first ends; and a second longeron cord interconnecting bulkhead second ends.

6. The antenna of claim 1, wherein each of said pair of booms curved between said boom first end and said boom second end, wherein said reflector supported by said plurality of bulkheads slidably disposed in spaced apart relation along said pair of booms has an arcuate reflector surface.

7. An antenna, comprising:

a main reflector assembly, including:

a boom having an arcuate body disposed between a boom first end and a boom second end;

a plurality of bulkheads disposed in spaced apart adjacent relation along said boom between said boom first end and said boom second end;

a reflector supported by said plurality of bulkheads disposed in spaced apart adjacent relation along said arcuate body;

a secondary boom; and a feed supported by said secondary boom, said secondary boom extendable to dispose said feed in fixed spatial relation to said main reflector assembly to transfer signals between said feed and said reflector.

8. The antenna of claim 1, wherein said boom having said arcuate body disposed between said boom first end and said boom second end stows in a substantially flattened wound condition extendable to dispose said plurality of bulkheads in spaced apart adjacent relation along said boom between said boom first end and said boom second end to support said reflector.

9. An antenna, comprising:

a main reflector assembly, including:

a boom having an arcuate body disposed between a boom first end and a boom second end;

a plurality of bulkheads disposed in spaced apart adjacent relation along said boom between said boom first end and said boom second end;

a reflector supported by said plurality of bulkheads disposed in spaced apart adjacent relation along said arcuate body;

a main reflector deployer assembly including one or more of:

a pair of stationary end pieces;

a boom spool rotationally journaled between said pair of stationary end pieces, said boom wound about said boom spool in said substantially flattened wound condition;

a plurality of slots circumferentially spaced about and radially outwardly extending from a spool longitudinal axis disposed in each of said pair of stationary end pieces, said plurality of slots in each of said pair of stationary end pieces aligned in opposite relation; and a plurality of boom pressers each disposed between a pair of boom presser ends, each pair of boom presser ends correspondingly slidably engaged in an aligned pair of slots disposed in said pair of stationary end pieces.

10. The antenna of claim 7, further comprising a secondary deployer assembly including one or more of:

a pair of stationary end pieces;

a secondary boom deployer spool rotationally journaled between said pair of stationary end pieces, said secondary boom wound about said secondary boom deployer spool in a substantially flattened wound condition;

a worm gear coupled to a spool end;

a worm rotationally engages said worm gear; and a worm drive operable to rotate said worm to correspondingly rotate said worm gear to correspondingly rotate said secondary boom deployer spool to deploy said secondary boom.

11. An antenna, comprising:

a main reflector assembly, including:

a boom having an arcuate body disposed between a boom first end and a boom second end;

a plurality of bulkheads disposed in spaced apart adjacent relation along said boom between said boom first end and said boom second end;

a reflector supported by said plurality of bulkheads disposed in spaced apart adjacent relation along said arcuate body;

an intermediate bulkhead boom interface coupled to said plurality of bulkheads, each said intermediate bulkhead boom interface including one or more of:

a boom passthrough in each of said plurality of bulkheads, said boom passthrough defined by a bulkhead aperture disposed in each of said plurality of bulkheads;

a boom interface annular member suspended by a boom interface neck within said boom passthrough, said boom interface annular member configured to engage a boom internal surface with said boom interface neck extending through a tube slit in said boom;

a first roller element rotationally coupled to said boom interface annular member opposite said boom interface neck, said first roller element rotationally engages said boom internal surface;

a second roller element disposed in opposite relation to said first roller element rotationally engage a boom external surface; and a springing element coupled between said aperture periphery said second roller element which allows said second roller element to correspondingly track along contours of said boom external surface.

12. An antenna, comprising:

a main reflector assembly, including:

a boom having an arcuate body disposed between a boom first end and a boom second end;

a plurality of bulkheads disposed in spaced apart adjacent relation along said boom between said boom first end and said boom second end;

a reflector supported by said plurality of bulkheads disposed in spaced apart adjacent relation along said arcuate body;

a terminal bulkhead interface coupled to said boom second end and a terminal bulkhead of said plurality of bulkheads, said terminal bulkhead interface including one or more of:

a springing element disposed between said boom second end and said terminal bulkhead, said springing element compresses to load or tension said main reflector assembly; and a pivot element disposed between said boom second end and said terminal bulkhead, said terminal bulkhead pivots in relation to said pivot element to reduce torsional moments on said boom.

13. An antenna comprising:

a feed disposed in fixed spatial relation between a pair of main reflector assemblies, each of said pair of main reflector assemblies deployable in opposite extending relation to provide in combination a reflector surface, wherein each of said pair of main reflector assemblies, including:

a plurality of booms each having an arcuate body disposed between a boom first end and a boom second end;

a plurality of bulkheads disposed in spaced apart adjacent relation along said boom between said boom first end and said boom second end, said plurality of bulkheads having a plurality of intermediate bulkheads and a terminal bulkhead, said boom second ends coupled to said terminal bulkheads, each of plurality of intermediate bulkheads slidably engaged to said plurality of booms;

a first net coupled to said plurality of bulkheads on bulkhead first sides; and a reflector supported by said first net.

14. An antenna, comprising:

a main reflector assembly, including:

a boom having an arcuate body disposed between a boom first end and a boom second end;

a plurality of bulkheads disposed in spaced apart adjacent relation along said boom between said boom first end and said boom second end;

a reflector supported by said plurality of bulkheads disposed in spaced apart adjacent relation along said arcuate body;

a feed disposed in fixed spatial relation to said main reflector assembly;

a secondary boom;

a sub-reflector supported by said secondary boom, said secondary boom extendable to dispose said sub-reflector in fixed spatial relation to said main reflector assembly to transfer signals between said feed and said reflector.

* * * * *